US012264553B2

(12) United States Patent
Dyck

(10) Patent No.: US 12,264,553 B2
(45) Date of Patent: Apr. 1, 2025

(54) STAGE TOOLS, STAGE TOOL ASSEMBLIES, CEMENTING OPERATIONS, AND RELATED METHODS OF USE

(71) Applicant: 2458584 ALBERTA LTD., Chestermere (CA)

(72) Inventor: David Dyck, Chestermere (CA)

(73) Assignee: 2,458,584 ALBERTA LTD., Chestermere (CA)

( * ) Notice: Subject to any disclaimer, the term of this patent is extended or adjusted under 35 U.S.C. 154(b) by 0 days.

(21) Appl. No.: 17/965,515

(22) Filed: Oct. 13, 2022

(65) Prior Publication Data

US 2023/0358114 A1 Nov. 9, 2023

(30) Foreign Application Priority Data

May 6, 2022 (CA) ..... 3158008

(51) Int. Cl.
*E21B 33/14* (2006.01)

(52) U.S. Cl.
CPC ..... *E21B 33/146* (2013.01)

(58) Field of Classification Search
CPC ..... E21B 33/146
See application file for complete search history.

(56) References Cited

U.S. PATENT DOCUMENTS 4,436,151 A * 3/1984 Callihan ..... E21B 33/16 166/317
4,450,912 A * 5/1984 Callihan ..... E21B 33/146 166/290
4,669,541 A * 6/1987 Bissonnette ..... E21B 34/14 166/154
11,414,956 B1 * 8/2022 Burris ..... E21B 43/12
2013/0240200 A1 * 9/2013 Frazier ..... E21B 33/129 166/135
2014/0076560 A1 * 3/2014 Kenyon ..... E21B 34/10 166/321
2014/0202768 A1 * 7/2014 Noske ..... E21B 21/103 175/57
2015/0159466 A1 * 6/2015 Themig ..... E21B 34/10 166/222
2015/0345252 A1 * 12/2015 Mcnabb ..... E21B 33/146 166/318
2016/0326836 A1 * 11/2016 Gonzalez ..... E21B 34/10
2022/0056781 A1 * 2/2022 Tiwari ..... E21B 33/13
2022/0195835 A1 * 6/2022 Acosta Villarreal ..... E21B 34/063
2022/0349272 A1 * 11/2022 Patil ..... E21B 33/16
2022/0381109 A1 * 12/2022 Hurtado ..... E21B 34/14

* cited by examiner

*Primary Examiner* — Shane Bomar
(74) *Attorney, Agent, or Firm* — Robert A. Nissen

(57) ABSTRACT

A stage tool assembly has a tubular body defining an interior bore with a port; an opening sleeve axially movable from a first position that restricts the port to a second position that exposes the port; a closing sleeve axially movable from a first position that exposes the port to a second position that restricts the port; and an isolation assembly downhole of the port that, at least when in an activated mode: permits tool passage in a downhole direction through the interior bore; and restricts flow through the interior bore.

22 Claims, 9 Drawing Sheets

STAGE TOOLS, STAGE TOOL ASSEMBLIES, CEMENTING OPERATIONS, AND RELATED METHODS OF USE

TECHNICAL FIELD

This document relates to stage tools, stage tool assemblies, cementing operations, and related methods of use.

BACKGROUND

The following paragraphs are not an admission that anything discussed in them is prior art or part of the knowledge of persons skilled in the art.

Embodiments of the present disclosure generally relate to a stage tool for use in open-hole completions.

DESCRIPTION OF THE RELATED ART

A wellbore completion string generally includes a tubular (casing string), a stage cementing tool and a lower completion. Stage cementing tools enable cementing of the tubular in the wellbore above an open-hole completion. Current hydraulic stage tool technology results in a small amount of undesired cement inside the tubular below the stage tool. The undesired cement may require a cleanout or drilling run, or increase the cost of the cleanout, or foul the open-hole pump-down tools, which may no longer function properly due to the fouling. Float-in subs using frangible discs are used to assist with installation of long tubulars by allowing the portion above the float-in sub to be filled with a higher density fluid and isolating a lower portion of the tubular which is filled with a lower density fluid; the frangible disc is ruptured when sufficient pressure is applied to allow liquid circulation through the lower portion of the tubular; however, the cost of these float-in subs is substantial and the debris can foul the open-hole pump-down tools, which may no longer function properly due to the fouling, or plug the floats (one-way valves) towards the toe of the tubular.

SUMMARY

The present disclosure generally relates to a stage tool including an isolation assembly oriented to allow flow in the downhole direction therethrough and to prevent or minimize cement ingress into the tubular below the isolation assembly. The isolation assembly may comprise one or more one-way valves which, in the closed position, seal to prevent flow in an uphole direction. A one-way valve may be installed in a closed-deactivated, activated, or open-deactivated position depending upon the requirements of the application. A one-way valve initially in a closed-deactivated position seals in both directions and isolates an upper portion of the tubular filled with a higher density fluid from a lower portion of the tubular filled with a lower density fluid. Once the tubular is positioned at the desired depth, increasing the differential pressure across the closed-deactivated one-way valve causes the one-way valve to move to an activated position. The isolation assembly in an open-deactivated or activated position allows flow of liquid and passage of pump-down tools such as balls, darts, plugs, keyed plugs, smart plugs or electronic plugs in a downhole direction therethrough prior to opening the stage tool. If the one-way valve is run in an open-deactivated position it is activated before or at approximately the same time as the stage tool is opened. The stage tool is opened to facilitate cementing of a tubular-wellbore annulus above the stage tool. A one-way valve may be held in the closed position during the cementing operation by a biasing device and/or pressure in the tubular below the one-way valve. A one-way valve may be a flapper type. The isolation assembly may be one or more non-sealing flow restrictors, or one or more non-sealing flow restrictors combined with one or more one-way valves. The isolation assembly prevents or minimizes cement entering the lower portion of the tubular below the isolation assembly. After cementing, the isolation assembly, or portions thereof, may dissolve or be drilled out to re-establish bi-directional flow through the stage tool.

A stage tool assembly is disclosed comprising: a tubular body defining an interior bore with a port; an opening sleeve axially movable from a first position that restricts the port to a second position that exposes the port; a closing sleeve axially movable from a first position that exposes the port to a second position that restricts the port; and an isolation assembly downhole of the port that, at least when in an activated mode: permits tool passage in a downhole direction through the interior bore; and restricts flow through the interior bore.

A method is disclosed comprising: installing a tubular body within a well that penetrates an underground formation, with a stage tool assembly located at an intermediate position within the well, in which the stage tool assembly defines an interior bore with a port and has an isolation assembly, downhole of the port, that, at least when in an activated mode: permits tool passage in a downhole direction through the interior bore; and restricts flow through the interior bore past the isolation assembly when pumping cement down the interior bore, out of the port, and up the annulus defined between the tubular body and the wellbore in a cementing operation.

In various embodiments, there may be included any one or more of the following features: The isolation assembly comprises a valve. The valve comprises a one-way valve. The one-way valve, when in the activated mode, restricts flow through the interior bore in an uphole direction. The valve comprises a flapper valve. The flapper valve is mounted to rotate about a hinge axis. The flapper valve is mounted such that in use the hinge axis translates along a non-zero path defined by a hinge slot. The valve is actuatable from a deactivated mode into the activated mode. When in the deactivated mode, the valve prevents tool passage in a downhole direction. When in the deactivated mode, the valve prevents flow through the interior bore, for example in both directions. A valve lock is structured to hold the valve in a closed position in the deactivated mode. The valve lock comprises a shear pin. The valve lock comprises a retainer sleeve axially movable from a first position that locks the valve in the deactivated mode to a second position that unlocks the valve into the activated mode. The valve is coupled by a hinge to an axially translatable sleeve which both translate in a downhole direction to move the flapper into the activated mode. The valve is moveable between an open position and a closed position. When in the activated mode, the valve is biased towards the closed position. A biasing member biases the valve into the closed configuration. When in the closed position and the activated mode, the valve is held in the closed position by a pressure differential across the valve. The valve comprises a pressure relief valve that allows flow in an uphole direction when a pressure differential across the valve exceeds a predetermined threshold. The isolation assembly comprises a flow restrictor. The flow restrictor comprises a plurality of fingers. The plurality of fingers form a finger basket. The isolation assembly comprises a one-way valve downhole of the flow restrictor.

The flow restrictor is structured to: open to permit tool passage in a downhole direction through the interior bore; and close in the absence of flow or tool passage to restrict flow within the interior bore. The isolation assembly is mounted within the tubular body of the stage tool assembly. The isolation assembly comprises a dissolvable material. The isolation assembly is located within 100 meters downhole of the port. The isolation assembly is located within 50 meters downhole of the port. The opening sleeve is actuatable by one or more of: a pressure above a predetermined threshold pressure; and a pump-down tool passed from uphole. The closing sleeve is actuatable by one or more of: a pump-down tool passed from uphole; or a translation movement of the tubular initiated from surface. One or more of opening sleeve has an uphole-facing seat; and the closing sleeve has an uphole-facing seat. The uphole-facing seat of the closing sleeve has a larger minimum inner diameter than the uphole-facing seat of the opening sleeve. The stage tool is structured such that, when the closing sleeve is in a closed position in use with a plug seated upon an uphole-facing seat of the closing seat, a volume of a fluid cavity defined within the interior bore of the tubular body between the plug and the isolation assembly is less than 10 liters. Installing the stage tool or stage tool assembly of within a well that penetrates an underground formation. A tubular string comprising the stage tool or stage tool assembly. The stage tool assembly is located uphole of an open hole lower completion. The open-hole lower completion comprises a multi-stage open-hole hydraulic-fracturing completion. The open-hole lower completion comprises two or more stimulation stages. Each stimulation stage comprises at least one hydraulic-set open hole packer and at least one sliding sleeve that is configured to expose a port thereof when the sliding sleeve is shifted into the open position by pressure after a pump-down tool of predetermined size or shape is landed on one or more seats of the stimulation stage. The open-hole lower completion comprises one or more of a screen, a slotted liner, a gravel pack, a flow control device, a flow control device blocked by a dissolvable plug, a flow control valve, a sidetrack, and a barefoot hole section. Carrying out a cementing operation, and in which: the isolation assembly comprises a one-way valve; and the cementing operation is carried out while the one-way valve is in a closed position. The cementing operation is carried out while the one-way valve is in the activated mode. Actuating the one-way valve between a deactivated mode and the activated mode. Installing the tubular body within the well is carried out while the isolation assembly is in the deactivated mode and a closed position. Installing the tubular body within the well comprises floating the stage tool assembly into position. Unlocking the one-way valve from the deactivated mode to the activated mode. Unlocking comprises applying hydraulic pressure to the one-way valve. The hydraulic pressure causes a retainer sleeve to axially move from a first position that locks the one-way valve in the deactivated mode to a second position that unlocks the one-way valve into the activated mode. Installing the tubular body within the well is carried out while the isolation assembly is in the deactivated mode and an open position. Unlocking occurs when the opening sleeve axially shifts to expose the port. During the cementing operation, the one-way valve is held in the closed position by a pressure differential across the one-way valve. Partially releasing differential pressure across the one-way valve via a pressure relief valve. Carrying out a cementing operation, and in which: the isolation assembly comprises a flow restrictor; and during the cementing operation, the flow restrictor restricts movement of cement downhole of the flow restrictor. During the cementing operation, a one-way valve downhole of the flow restrictor restricts flow of cement downhole of the flow restrictor. Carrying out a cementing operation; and after cementing, one or more of dissolving, drilling, or destroying the isolation assembly. Opening the port; and carrying out a cementing operation. After the cementing operation, closing the port. Passing one or more pump-down tools and fluids through the interior bore of the stage tool assembly; and carrying out a cementing operation. Carrying out one or more stimulation operations, of the underground formation, downhole of the stage tool assembly, after the cementing operation.

The foregoing summary is not intended to summarize each potential embodiment or every aspect of the subject matter of the present disclosure. These and other aspects of the device and method are set out in the claims.

BRIEF DESCRIPTION OF THE DRAWINGS

Embodiments will now be described with reference to the figures, in which like reference characters denote like elements, by way of example, and in which.

DETAILED DESCRIPTION

Figure 1A:
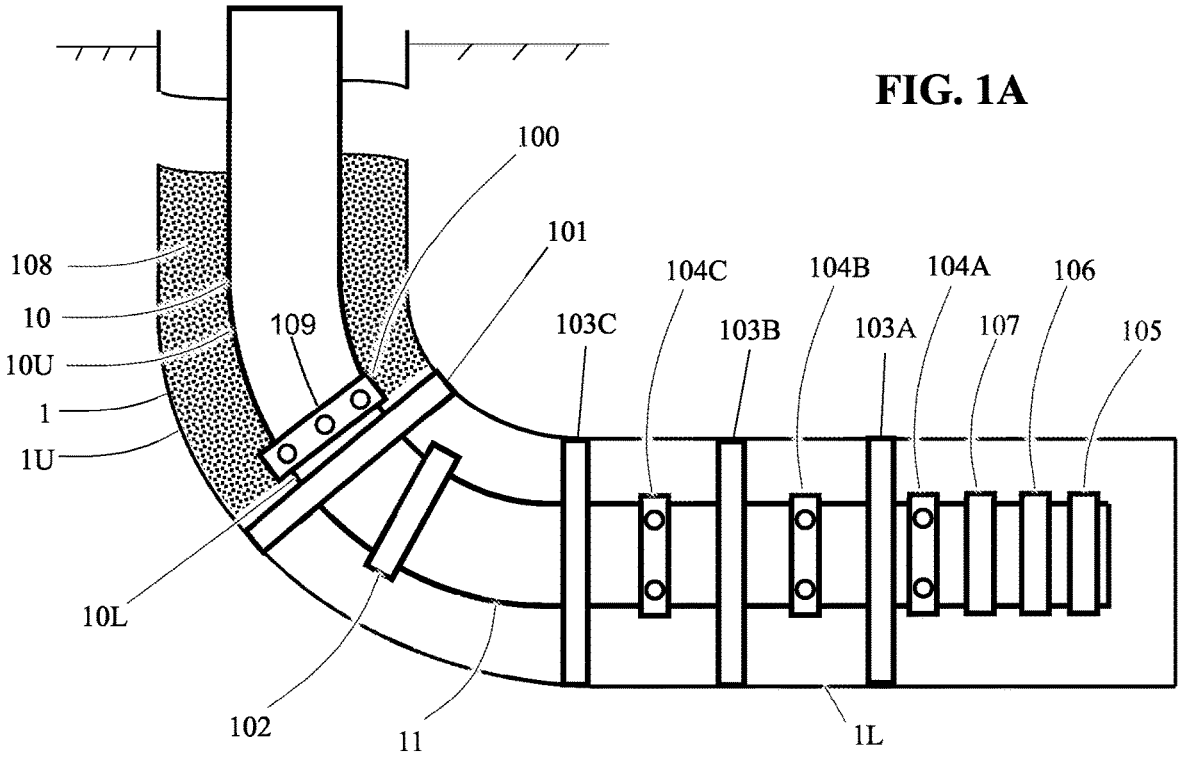
FIG. 1A is a side elevation view of a stage tool within a tubular in a wellbore that penetrates an underground formation, the stage tool incorporating an isolation assembly.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

Features and their benefits are only discussed in detail for the first figure for which they are shown. In general, the complexity of embodiments increases sequentially through the Figs. and for the sake of clarity and brevity. In order to understand the configuration and benefits of features shown in certain figures, it may be necessary to read the entire description to that point and applying the understanding of features, configurations, and benefits from previous Figs. into the reading of subsequent figures.

The term "isolation assembly" as used herein refers to a device which allows at least flow in a downhole direction therethrough when activated, and may comprise a non-sealing flow restrictor and or a sealing one-way valve. An isolation assembly in use prevents or reduces the undesired passage of cement therethrough.

The term "flow restrictor" as used herein refers to a non-sealing isolation assembly.

The term "one-way valve" as used herein refers to an isolation assembly which, when activated prevents bulk flow in an uphole direction and may trap a differential pressure below.

The terms "couple" or "couples," as used herein are intended to mean either an indirect or direct connection. Thus, if a first device couples to a second device, that connection may be through a direct connection such as a thread, flange, pin, or weld connection, or through an indirect coupling via other devices and connections.

The term "shearable device" as used herein refers to a structure that couples components together and in use fails in a shear mode to allow movement of a structure. The most common shearable device is shear pins (shown throughout), but the same function may be achieved with other shearable devices such as shear screws, a shearable snap ring, a shearable lock wire, or shearing tabs (which may be integral with the stationary or moveable structure), or other related devices.

The term "fluid" is used to refer to generally liquids or gasses or mixtures thereof.

The term "liquid" refers to a fluid which is primarily, or primarily intended, to be composed of liquid and typically includes the presence of some gas which may be dissolved or entrained in the liquid as bubbles.

The term "gas" refers to a fluid which is primarily, or primarily intended, to be composed of gas. Typically, during the installation of a floated tubular, the gas comprises primarily of air, but may include condensable vapors, nitrogen, or other gasses.

The term "uphole", "upper", or "top" is used to refer to the location closest to the rig or wellhead along the wellbore in the orientation of intended use. Correspondingly "downhole", "bottom", or "lower" refers to the location furthest from the rig or wellhead along the wellbore in the orientation of intended use, regardless of the horizontal or vertical orientation of the device or wellbore.

The term "forward circulation" refers to a direction of pumping where flow is in a downhole direction inside the tubular, and in an uphole direction in the annulus formed between the tubular and the wellbore.

The term "wellbore" refers generally to the hole in which the tubular is installed (inserted), the wellbore typically comprises of a borehole in the earth and other larger tubulars (e.g., conductor, surface casing, or other casing strings).

The term "radial inward" refers to a radial position that is relatively closer to the axis than another part or position. "Inside" and "inner" may be used interchangeably with "radial inward" unless context dictates otherwise.

The term "radial outward" refers to a radial position that is relatively far from the axis than another part or position. "Outside" and "outer" may be used interchangeably with "radial outward" unless context dictates otherwise.

The term "floats" refers to a one-way valve, typically of plunger type, located in a tubular, and typically within 50 m of the distal end (the toe)

The term "seat" refers to a profile, typically with a bevelled or chamfered profile on the edge intended for pump-down tools such as balls, darts, plugs, keyed plugs, smart plugs, electronic plugs or wiper plugs to land thereon in a sealing manner. Seats may be designed to latch onto the pump-down tool that lands in it to retain the pump-down tool. Once a pump-down tool is landed on a seat it typically seals against flow or pressure in a downhole direction, but may also create a two-way seal. Seats may be integral with or coupled to sleeves which are caused to slide by pressure applied above the seat after it has been sealed by a pump-down tool. Seat is also used for the profile which a one-way valve seals on, which may have a circular conical or flat seal face, or a pringle-shaped face to accommodate a large-drift flapper.

The term "seal" refers to prevention of flow or transmission of pressure, but may be used inclusively of imperfect seals which may allow limited passage of fluids and/or pressure to bypass the seal.

The term "actuated" refers to the intentional functioning or moving of a component. E.g., an opening sleeve is actuated when it is shifted from its RIH position blocking (preventing flow through) ports to a position exposing (allowing flow through) ports, a closing sleeve is actuated when it is shifted from its RIH position exposing ports to a position blocking ports.

The term "ball" refers to a pump-down tool that may be conveyed through a wellbore tubular by gravity or by flow of fluid. Balls are most commonly used, but the broadest interpretation should be made where almost all applications where balls are mentioned in the present disclosure, the same function may be performed instead also by a dart, plug, keyed plug, smart plug, electronic plug or other similar tool.

The term "cement" refers to any grouting material that may be used to isolate portions of the annulus between the upper portion of the tubular and the wellbore. Typical grouting materials are Portland cement based, but may include any grouting material which may or may not have cementitious properties. Grouting material (cement) is pumped in a fluid form, typically known as a slurry, before it sets into a solid form.

A wellbore completion (or casing) string generally includes an upper portion of a tubular, a stage cementing tool, and a lower portion of a tubular. Stage cementing tools enable cementing of the upper portion of the tubular in the wellbore above a lower portion of the tubular comprising an open-hole completion. Stage tools for example, are proposed in U.S. Pat. Nos. 8,800,655 and 9,121,255. Current hydraulic stage tool technology results in a small amount of undesired cement inside the tubular below the stage tool. The undesired cement may require a cleanout or drilling run, or increase the cost of the cleanout, or foul the open-hole tools pump-down tools, which may no longer function properly due to the fouling.

An isolation assembly to mitigate the problem of cement below the stage tool (and also to allow pressure testing to be used to assess whether the stage tool port or a toe port opened) is proposed in U.S. Pat. No. 9,909,390. In order to prevent ingress of cement into the lower completion below the stage tool, prior to the stage cementing operation, an isolation assembly is closed and seals, preventing fluid flow in a downhole direction therethrough. It does not disclose a one-way valve oriented in the same direction as the present disclosure which allows uninterrupted forward circulation, and the passage of pump-down tools such as balls, darts, plugs, or keyed plugs in a downward direction. Instead, it proposed that the one-way valve must be in an open-deactivated position while fluids or pump-down tools are pumped in a downhole direction therethrough. It does not contemplate the potential to trap a greater pressure in the lower completion in order to maintain the isolation assembly in a closed position during the stage cementing operation. A critical function of the stage tool is that a closing sleeve must be able to shift fully to a closed position, typically when a cement-wiper-plug is landed on a closing seat; however, the isolation assembly proposed which prevents the movement of fluids in a downhole direction may also cause the closing sleeve to hydraulic lock before it reaches the fully closed position because of the small trapped fluid volume above the isolation assembly which does not have sufficient compressibility to allow the closing sleeve to be shifted to a fully closed position. This may have been addressed by coupling the isolation assembly to the closing sleeve to allow the isolation assembly to shift in a downhole direction when the plug is bumped to avoid fluid locking. Drawbacks of such a long closing sleeve which includes the isolation assembly are first: an increased chance of binding when attempting to close the closing sleeve if the tubular is installed in a dogleg (curved portion of the wellbore). Second: application of excessive differential pressure across the one-way valve during cementing operations may result in premature activation of the closing sleeve. Third: the extra drill out time required to remove the extended sleeve increases the cost and increases the chances of failing the closing sleeve seals resulting in a potential leak to the annulus through the stage tool. This fluid locking limitation is resolved by the present disclosure wherein the one-way valve allows fluid to pass therethrough in a downhole direction as the closing sleeve is shifted fully into a closed position.

Float-in subs are used to assist with installation of long tubulars by allowing the portion above the float-in sub to be filled with a heavier fluid (typically a liquid—drilling mud) and isolating a lower portion of the tubular which is filled with a lower density fluid (typically a gas—air). The weight of the fluid above the float-in sub which is in a substantially vertical portion of the wellbore assists in pushing the tubular into the wellbore particularly where the low-density-fluid-filled lower portion of the tubular is at a substantially horizontal inclination. The float-in sub is opened to allow circulation and passage of tools inside the tubular by application of pressure above the float-in sub which opens a flow path therethrough. Float-in subs are typically made using frangible discs which are broken into many pieces to establish a flow path. The frangible disc is typically ruptured by application of pressure (combined hydrostatic plus applied pressure). The cost of these frangible discs may be substantial and the debris may be problematic because it can damage or foul the open-hole pump-down tools, which may no longer function properly. The rupture pressure of a frangible disc may be less consistent than the rupture pressure of shear pins or other shearable devices. Additionally, the debris may plug the floats (one-way valves) at the toe of the tubular which can be a significant problem if it prevents pumping at sufficient rates for placement of completions fluids, well control, or pump-down conveyance of pump-down tools such as balls, darts, plugs, keyed plugs, smart plugs or electronic plugs. The author is not aware of prior art using a one-way valve in a deactivated-closed position as a float-in sub in any application (most applications that use a float-in sub, but no stage cementing tool, do not require a drill out run after installation).

A stage tool or stage tool assembly is disclosed including an isolation assembly to allow flow in the downhole direction therethrough that in use prevents or minimizes placement of cement into the lower portion of the tubular while cement is being pumped through the one or more ports of the stage tool. The isolation assembly may comprise one or more non-sealing flow restrictors, one or more sealing one-way valves, one or more pressure relief valves, or combination thereof. The stage tool assembly may be installed within a well that penetrates an underground formation. The stage tool assembly may form part of a tubular string. A one-way valve may be run-in-hole (RIH) in a closed-deactivated, active, or open-deactivated position depending upon the application requirements. If the one-way valve is RIH in a closed-deactivated position it may also be used to fulfil the function of a float-in sub. If the one-way valve is RIH in a closed-deactivated position it may be activated by application of sufficient pressure to open and activate the one-way valve; this activation of the one-way valve from a closed-deactivated position might typically occur once the tubular has been RIH to the desired depth; then after the one-way valve is activated the wellbore may be circulated with completions fluid and pump-down tools such as balls, darts, plugs, keyed plugs, smart plugs or electronic plugs may be pumped through the one-way valve that may land in a seat towards the toe of the tubular in order to seal the flow path to the toe and/or to set open hole packers and open the stage tool. The one-way valve may be RIH in an open-deactivated position in order to ensure that pump-down tools can freely pass prior to activation of the one-way valve. If the one-way valve is RIH in an open-deactivated configuration it may be activated approximately at the same time (including before or immediately after) the stage tool is opened, and may be activated indirectly or directly by the motion of the stage tool opening sleeve. The one-way valve may remain in an activated position throughout the remainder of the cementing operations. Throughout the cementing operations the one-way valve is in an activated position, and expected to be held closed against the seat.

When in the activated position, the one-way valve may be biased towards a closed position by a biasing member such as a torsion spring (not shown in the figures) and/or it may be closed by flow in an uphole direction, in the closed position the one-way valve may be held against the seat by pressure trapped below the one-way valve. A one-way valve allows uninhibited passage of fluids and pump-down tools such as balls, darts, plugs, keyed plugs, smart plugs or electronic plugs in a downhole direction, and prevents flow in an uphole direction; in applications such as a typical multi-stage hydraulic fracture open-hole completion with a sealed lower-completion, the one-way valve may allow pressure to be trapped below the one-way valve which is greater than the pressure above the one-way valve—this pressure differential maintains the one-way valve in a closed position throughout the cementing operation. After cementing, the isolation assembly, or portions thereof, may dissolve or be drilled out to re-establish flow through the stage tool.

FIG. 1A illustrates a tubular body 10 with a stage tool assembly 100 and an open-hole lower completion (11 and 103 through 107) including a stage tool assembly 100 having an integral isolation assembly 109, according to one embodiment of the disclosure. Below the stage tool there may be an open hole packer 101 to isolate the upper wellbore 1U which will be cemented from the lower wellbore 1L which is not cemented in the annulus between the lower portion of the tubular body 10L and the wellbore 1L. A debris sub 102 may be located down hole of the stage tool assembly 100 to catch debris of the stage tool assembly 100 during the drill out process and to enable adequate drilling of the stage tool assembly 100 components and their removal from the wellbore instead of allowing them to fall into the lower completion 11 where they may foul or damage tools in the lower completion 11. The debris sub 102 also provides a backup seat below the stage tool assembly 100 which may be used to land a ball on to function open-hole packer 101 and the stage tool assembly 100 in the event that a ball cannot be landed in ball seat 107.

The example open-hole lower completion 11 shown is a multi-stage horizontal hydraulic-fracturing assembly which includes a tubular body 10, typically called casing, positioned within a lower portion of wellbore 1L which is typically approximately horizontal. The stage tool assembly 100 may be used with other types of tools in the open-hole lower completion 11 including various hardware that include open-hole packers, sliding sleeves, screens, slotted liner, flow control devices, flow control devices blocked by dissolvable plugs, flow control valves, sidetracks, gravel packs, and/or barefoot hole sections. The lower completion 11 may be horizontal, vertical, or any inclination. The stage tool assembly 100 may be installed at any inclination in the wellbore 1 (including horizontal, vertical, or any inclination between). Completion operations may include a variety of formation-stimulation methods that may include hydraulic-fracturing, acidizing, or other methods as is known in the art. The lower completion 11 includes a tubular body 10 and one or more packers 103 *a,b,c* (three are shown) positioned therearound and spaced in intervals from one another. The packers 103 *a,b,c* may be adapted to form a seal between the lower portions 1L of the wellbore 1 and the tubular body 10. The lower completion 11 includes one or more ported devices 104 *a,b,c*, such as sliding sleeves, to enable flow through the sidewall of the tubular body 10. The one or more ported devices 104 *a,b,c* may be positioned between packers 103 *a,b,c* to facilitate isolated injection of stimulation treatments (such as a hydraulic fracturing treatment) and production from desired regions of the hydrocarbon-bearing reservoir. Each stimulation stage comprises at least one hydraulic-set open hole packer and at least one sliding sleeve that is configured to expose a port thereof when the sliding sleeve is shifted into the open position by pressure after a pump-down tool is landed on the seats of the one or more ported devices of the stimulation stage. One or more ported device may be positioned between adjacent packers. A float shoe 105 and a float collar 106 may be disposed at a distal end (e.g., the toe end) of the tubular body 10. The float shoes 105 and 106 may comprise one-way check valves to prevent reverse flow or U-tubing. If the lower portion of the tubular body 10L is floated into position then the floats prevent wellbore fluids from filling the lower portion of the tubular body 10L. A ball seat 107 is positioned uphole of the float collar 106. The ball seat 107 is adapted to receive a pump-down tool, such as a ball, dart, plug, keyed plug, smart plug or electronic plug to prevent flow therethrough and facilitate a pressure increase within the tubular body 10. During operation, a plug such as a ball (not shown) is inserted into the tubular body 10 at surface (launched) and pumped downhole until it lands in the ball seat 107 to restrict flow therethrough. As fluid is pumped into the sealed tubular body 10, pressure therein increases to set the packer 101 and to set lower completion 11 packers 103 *a,b,c*. After setting the packers, the pressure is increased to open of the stage tool assembly 100, and cementing operations place cement 108 into the annulus between the vertical portion of the wellbore 1U and the upper portion of the tubular body 10U. Cement is pumped from surface in a forward direction, and chased with a wiper plug which may land in the stage tool assembly 100. Cement exits the tubular body 10 through ports in the stage tool assembly 100, cement in the annulus is prohibited from traveling substantially in a downhole direction by the packer 101 below the stage tool assembly 100. Bulk flow of fluids is prohibited from traveling in a downhole direction inside the lower portion of the tubular body 10L below the stage tool assembly 100 by the plugged ball seat 107; however, undesired cement may still enter the lower portion of the tubular body 10L below the stage tool assembly 100, primarily due to two phenomena. The first phenomenon is specific-gravity swapping where cement of a higher density sinks relative to the lower density fluid in the lower portion of the tubular body 10L. The second phenomenon is the compressibility of the lower portion of the tubular body 10L and the fluid within it; the downhole pressure at the location of the stage tool assembly 100 increases throughout the cement job due to circulation pressure (often called Effective Circulating Density or ECD) which is the sum of pressure generated by fluid friction in the upper portion of the wellbore 1U and the relatively higher density of cement compared to the fluid (typically drilling mud) that is being displaced from upper portions of the wellbore 1U, which results in a pressure increase at the stage tool assembly 100 location (the pressure increase is typically on the order of 5 to 30 MPa), and depending on the properties of the lower portion of the tubular body 10L (tubular and fluid properties) this pressure increase and compressibility of the lower portion of the tubular body 10L and fluid therein may result in a volume up to approximately 1,000 litres of cement being "squeezed" into the lower completion 11 during the cement job. An isolation assembly 110 may be a one-way valve positioned below the ports 203 of the stage tool assembly 100 and above the lower completion 11, and may prevent undesired cement ingress to the lower completion 11 by trapping a pressure inside the lower portion of the tubular body 10L that is equal or greater to the maximum pressure that will be exerted above the one-way valve during the cementing operations; this trapped pressure below the one-way valve may hold the one-way valve in the closed position which prevents undesired cement placement inside the lower portion of the tubular body 10L or the lower completion 11. A wiper plug 270, stage tool assembly 100, isolation assembly(s) 110, and debris sub 102 may then be drilled out or may dissolve to re-establish bi-directional flow through the tubular body 10. If the stage tool assembly 100 and isolation assembly 110 are dissolved reliably with an acceptably small volume of cement residue inside the tubular body 10, then the debris sub 102 may not be necessary, or the debris sub 102 may also comprise a dissolvable seat and ball. An isolation assembly 110 is installed below and preferably as close to the location of the stage tool ports 203 as possible, and is therefore envisioned to be integral with the stage-tool assembly 100 as shown in FIG. 1A; however, the isolation assembly 110 may also be integral with the debris sub 102, or the isolation assembly 110 could be a standalone component which is coupled to the tubular body 10 at any location between the stage tool assembly 100 and the lower completion 11 (one such alternative embodiment shown in FIG. 1B). One or more one-way valves 240 may be combined with one or more flow restrictors 280 between the stage tool ports 203 and the lower completion 11 which may improve the reliability of obtaining a seal and reduce the volume of cement residue. The isolation assembly 110 may be located within 100 meters (for example within 50 meters) downhole of the port. The effectiveness of an isolation assembly 110 to prevent cement ingress below the stage tool ports 203 may diminish as the distance between the isolation assembly 110 and the stage tool ports 203 is increased; it is believed that if the distance between the stage tool assembly 100 and the uppermost isolation assembly 110 were to exceed 100 m that the technical and cost saving benefits may be reduced to a small benefit that does not justify the cost of the isolation assembly 110 for a typical horizontal open hole completion application. Put in a more general way, the technical and cost saving benefits may be reduced to a small benefit that does not justify the cost of the isolation assembly if the ratio of the length of tubular between the ports and the isolation assembly to the length of the tubular between the ports and the distal (toe) end of the tubular is less than 1:5.

Figure 1B:
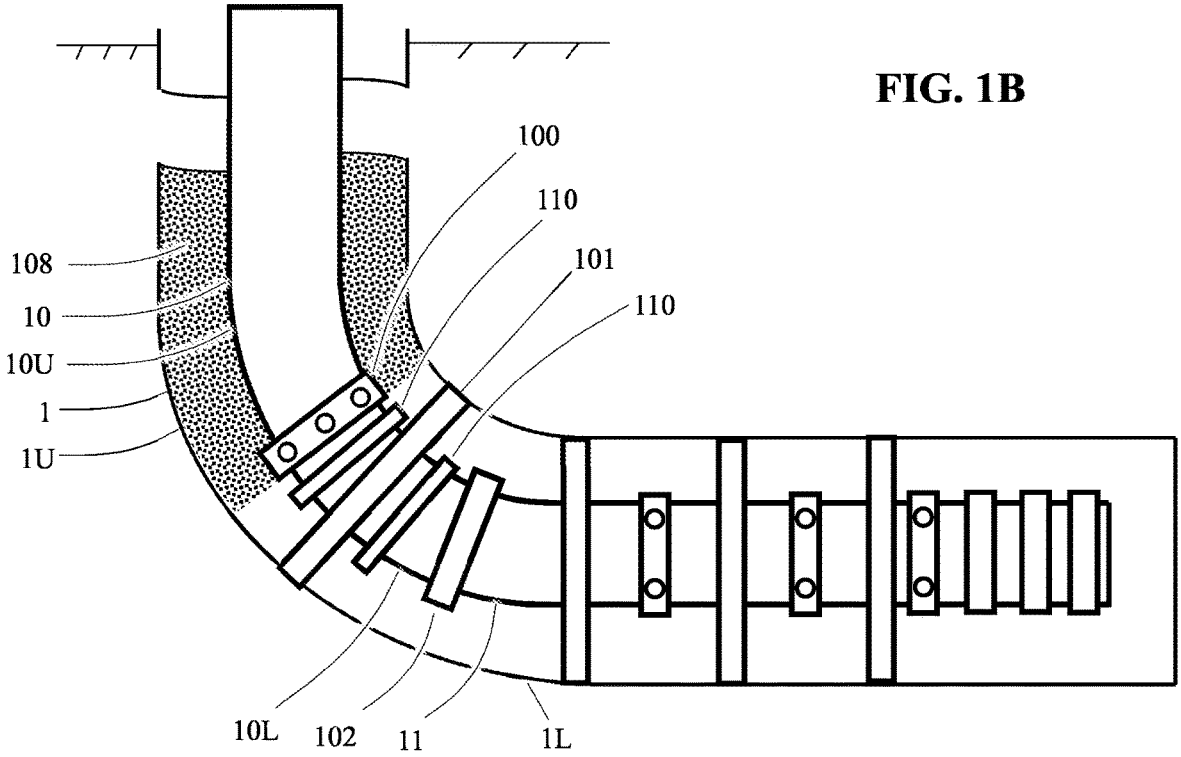
FIG. 1B is a side elevation view of an isolation assembly below a stage tool within a tubular in a wellbore.

FIG. 1B illustrates an alternative embodiment including tubular body 10 with a stage tool assembly 100, an open-hole lower completion (11), and one or more isolation assemblies 110 located between the stage tool assembly 100 and the open hole lower completion 11. For example, two isolation assemblies 110 are shown, one is above an open hole packer 101, and another is below an open hole packer 101. Either isolation assembly 110 may be a flow restrictor or a one-way valve.

Figure 2A:
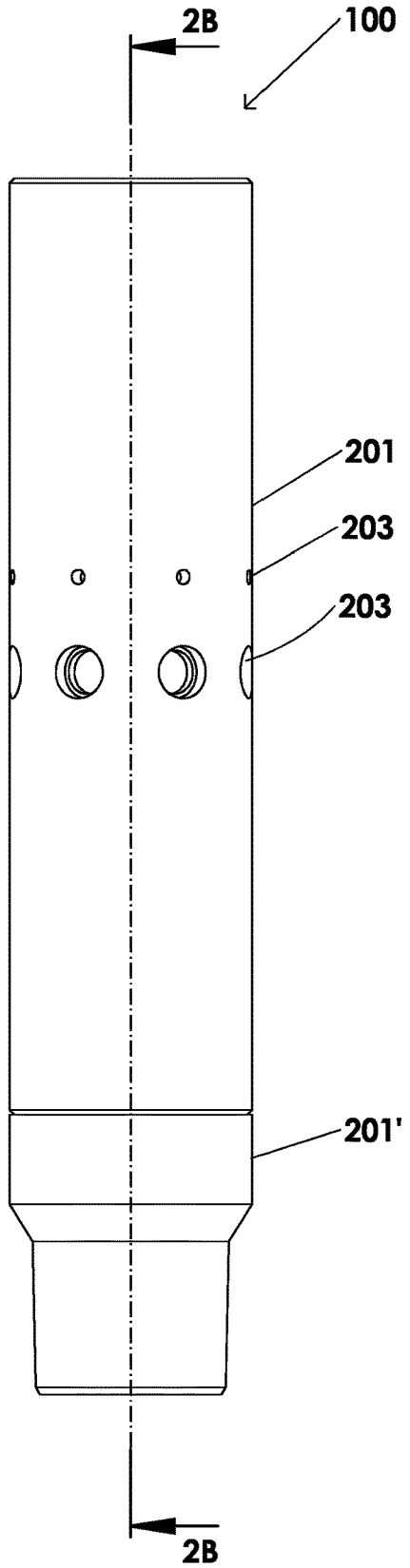
Fig. 2A PRIOR ART
FIG. 2A is a side elevation view of a prior art stage tool in a RIH configuration.
Figure 2B:
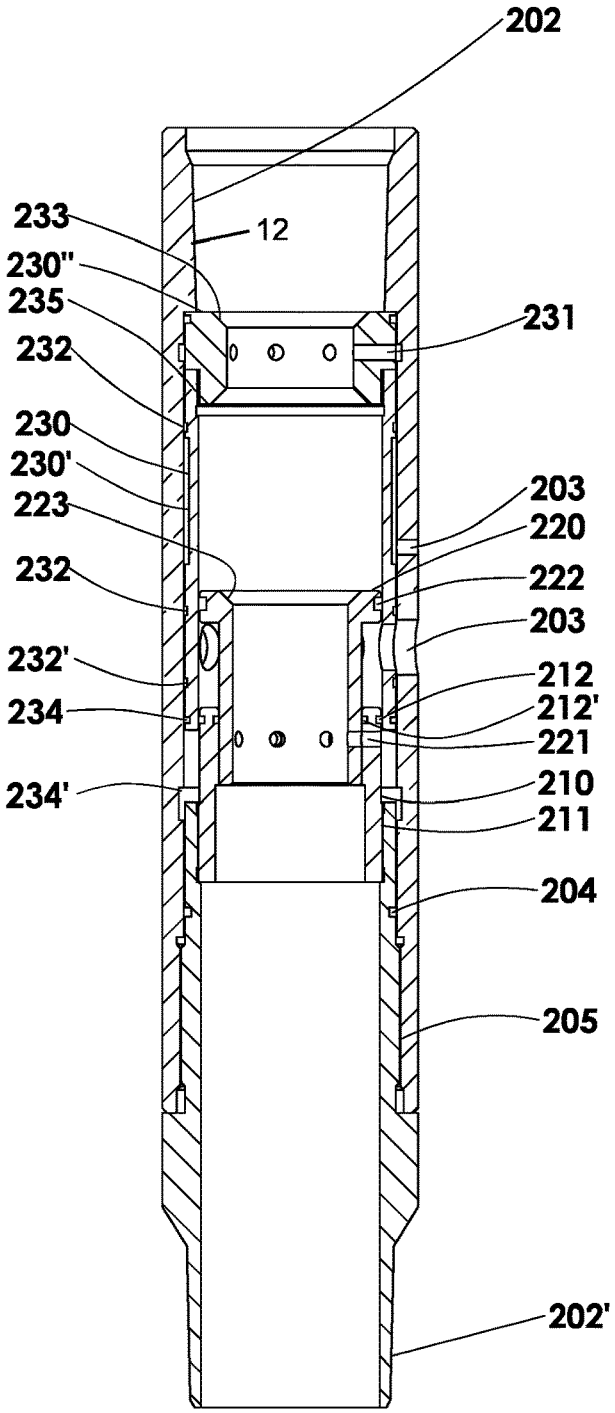
Fig. 2B PRIOR ART
FIG. 2B is a view taken along the 2B-2B section lines in FIG. 2A.

FIGS. 2A-2B illustrate the operation of a typical prior art stage tool in a run-in-hole (RIH) configuration. The stage tool assembly 100 includes a top housing 201 with a top female threaded connection 202 for coupling to the upper portion of the tubular body 10U (not shown) and ports 203 formed through the sidewall thereof, a bottom housing 201' with a bottom male threaded connection 202' for coupling to the lower portion of the tubular body 10L. It is contemplated that the tubular body may be single member, or formed from multiple members as shown with two, or more than two housing components. One or more seals 204, such as O-rings, may be disposed between the housing members to facilitate sealing therebetween. The housing members may be coupled with a threaded connection 205. A removeable ring/sleeve 210 is coupled to a housing in this embodiment by means of a thread 211 to the bottom housing 201'. This removeable sleeve 210 carries outer seals 212 and inner seals 212', and a main purpose of the sleeve 210 may be to create an inner seal 212' which is at a smaller diameter than the outer seal of the opening sleeve 222. In the RIH configuration, the opening sleeve 220 is coupled to the sleeve 210 by means shear pins 221. The differential in hydraulic area between the opening sleeve 222 outer seals and inner seals 212' allow the opening sleeve to be shifted by means of a differential pressure between the inside and the outside of stage tool assembly 100. If necessary, a pump-down tool such as a ball, dart, plug, or keyed plug may be seated on an opening sleeve seat profile 223 at the top of the opening sleeve 220 to increase the hydraulic area and shift the opening sleeve into the open position to provide a greater force at the same applied differential pressure. The opening sleeve may be actuatable by one or more of: a pressure above a predetermined threshold pressure, and a pump-down tool passed from uphole. After shifting the opening sleeve 220 to the open position, the ports 203 are exposed and cementing operations proceed to pump cement in a forward direction through the ports 203. After completing the cementing operation, a wiper plug 270 seats on a closing sleeve seat profile 233 of the closing sleeve 230 and pressure applied above the wiper plug 270 is used to shear pins 231 and shift the closing sleeve 230 in a downwards direction to cover the ports 203 (not shown, refer to FIG. 5A to view the stage tool closed configuration). The closing sleeve may be actuatable by one or more of: a pump-down tool passed from uphole, a pressure above a predetermined threshold pressure, and a translation movement of the tubular initiated from surface. After shifting the closing sleeve 230 to the closed position, primary seals 232 straddle the ports thereby restoring pressure integrity between the inside and the outside of the stage tool assembly 100. A temporary seal 232' provides pressure integrity across the stage tool in the RIH configuration. Once shifted to the closed position a snap ring 234 expands into groove 234' to retain the closing sleeve 230 in the fully closed position. The closing sleeve 230 may comprise two or more components coupled together for example by a thread 235, the first component of the closing sleeve 230 is a permanent sleeve 230' which carries the seals 232 and is made of a high strength material (typically steel), the second component of the closing sleeve 230 is a closing seat 230" which is made of a lower strength and more easily removed material and typically drilled out or dissolved (typically cast iron, aluminum, or magnesium alloy). The opening sleeve 220 and removeable sleeve 210 are typically removed prior to completions or production operations to restore full internal drift access to tubular below the stage tool. The uphole-facing seat of the closing sleeve may have a larger minimum inner diameter than the uphole-facing seat of the opening sleeve, to permit cooperation between the seats and the sleeves 220, 230. When the closing sleeve is in a closed position in use with a plug seated upon an uphole-facing seat of the closing seat, a volume of a fluid cavity defined within the interior bore of the tubular body between the plug and the isolation assembly may be a sufficiently small volume, for example less than 10 liters.

Figure 3A:
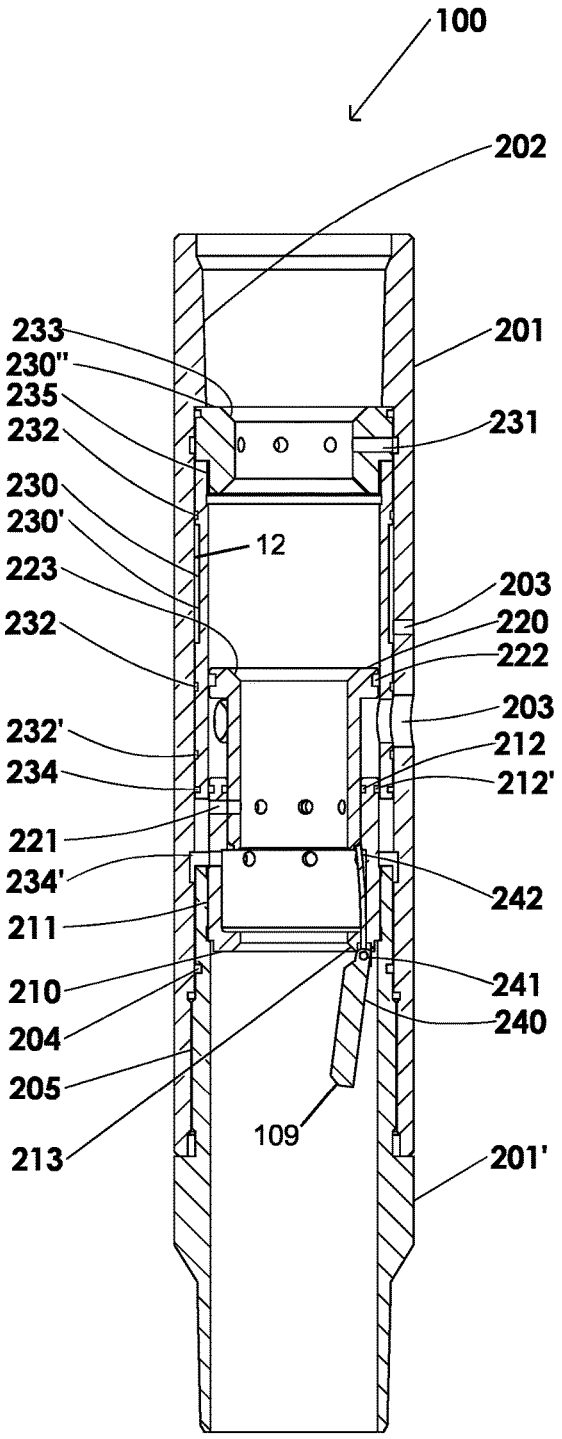
FIG. 3A is a side cross section view of an embodiment of a stage tool with an integral one-way valve, wherein the one-way valve is a flapper type in a deactivated-open position and the stage tool is in a RIH configuration.
Figure 3B:
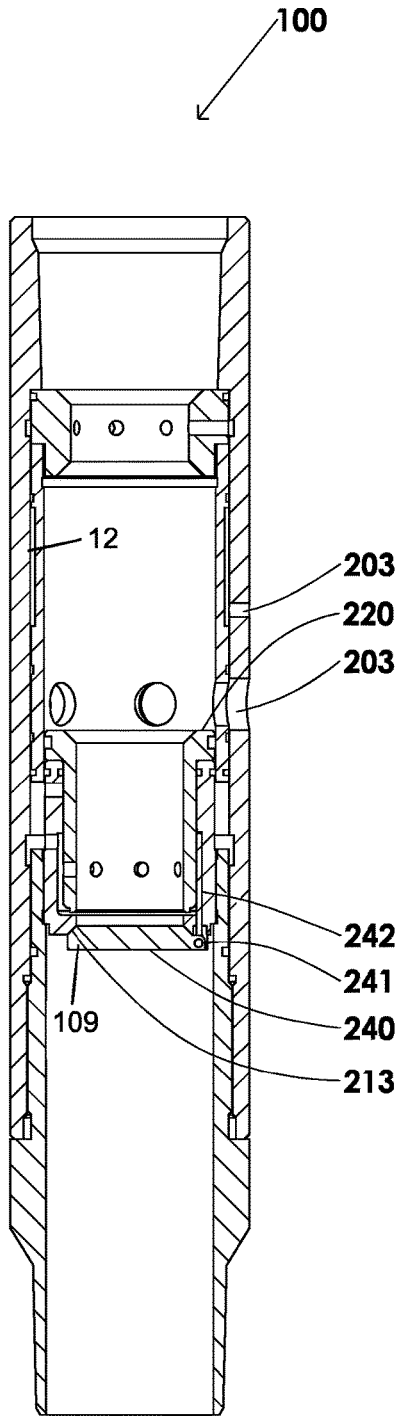
FIG. 3B is a side cross section view of FIG. 3A after the opening sleeve is actuated and the one-way valve is activated—(shown in a closed position) and the stage tool is in an open configuration.

FIGS. 3A-3B illustrate a stage tool assembly 100 with a tubular body 10 and an isolation assembly 109. The tubular body 10 may be installed within a well that penetrates an underground formation, with a stage tool assembly located at an intermediate position within the well. The tool assembly 100 may have an opening sleeve 220 and a closing sleeve 230. The tubular body 10 (which may be made of more than one sub or housing) may define an interior bore 12 with a port or ports 203. The opening sleeve 220 may be axially movable from a first position that restricts the port 203 to a second position that exposes the port 203. The closing sleeve 230 may be axially movable from a first position that exposes the port 203 to a second position that restricts the port 203. The isolation assembly 109 may be downhole of the port 203. Referring to FIG. 3B, the assembly 109 may, at least when in an activated mode permit tool passage (passage of a pump-down tool) in a downhole direction through the interior bore 12. At least when in the activated mode, the assembly 109 may restrict flow through the interior bore 12, for example in an uphole direction in the case of FIGS. 3A-B. Flow may be restricted through the interior bore past the isolation assembly when pumping cement down the interior bore, out of the port, and up the annulus defined between the tubular body and the wellbore in a cementing operation.

Referring to FIGS. 3A-B, the isolation assembly 109 is shown in the example as a valve, such as a one-way valve. The valve may be located below, i.e., downhole, the ports 203. FIG. 3A illustrates the cross-section view of the stage tool assembly 100 in the RIH configuration, and the one-way valve in a deactivated-open configuration, while FIG. 3B illustrates an activated configuration. The one-way valve may be integral (the isolation assembly is mounted within the tubular body of the stage tool) with the stage tool assembly 100. The one-way valve may be of a flapper valve 240 type, for example mounted to rotate about a hinge axis, which may be defined by a hinge 241. Hinge 241 may be between the flapper valve 240 and a sleeve 210. In the closed position, the flapper may seal to prevent flow in an up-hole direction within the tubular body 10. A seal between the flapper valve 240 and the sleeve 210 may be formed by a flapper seat profile 213. The flapper seat profile 213 may be metal-to-metal or include an elastomeric, metallic, polymer elements or combinations thereof in a groove (not shown). A circular and angled seat profile is shown; however, an alternate design which allows the largest possible diameter for pump-down tool passage therethrough, uses a curved (pringle-shaped) seat profile with matching flapper curvature may be used (e.g., the flapper and seat geometry illustrated in US20190264534A1). The valve may be actuatable from a deactivated mode into the activated mode, from the activated mode into the deactivated mode, or both. The valve may be held in a deactivated position (by a suitable mechanism) initially or during run-in. In one embodiment, a flapper valve 240 is held in a deactivated-open position through the use of hinge slot 241' of a sleeve (which may be removable, for example in the case of a removable sleeve). When the flapper valve 240 is shifted towards an uphole position within the hinge slot 241' (refer to FIG. 8 detail), the flapper valve 240 may be held open. When the flapper valve 240 is shifted towards a downhole position within the slot, the flapper valve 240 may be free to rotate about the hinge 241 (refer to detail in FIG. 8). When in the activated mode, the valve may be biased towards the closed position. The flapper valve 240 may be biased towards a closed position by a biasing device (not shown, this may be achieved using a biasing member such as a torsion spring). A flapper is one example of a valve that is moveable between an open position and a closed position. A flapper valve 240 may still function as a one-way valve without a biasing device. The hinge pin is also not shown. The valve may be coupled by a hinge to an axially translatable sleeve, such as sleeve 210, which both translate in a downhole direction to move the flapper into the activated mode. The flapper valve 240 may be moved into downhole position by the motion of the opening sleeve 220 which is transmitted through a flapper poker 242; the flapper poker 242 may be a rod that is positioned between the opening sleeve 220 and the flapper valve 240; the flapper poker 242 may be elastically bent in the RIH configuration in a manner that it biases towards a straight alignment to remove itself from contact with the opening sleeve 220 after the flapper poker 242 has completed a downward stroke of sufficient length to move the flapper valve 240 into the activated position; the flapper poker 242 then rebounds back to a straight alignment within a space between the removeable sleeve 210 and the opening sleeve 220 which allows the opening sleeve 220 to move the remainder of the stroke length of the opening sleeve 220 without interference from the flapper poker 242. Seals (not shown) may be disposed between a flapper poker 242 and the removeable sleeve 210. Alternatively, the flapper valve 240 may be installed in the activated position. In the activated position the flapper valve 240 may be biased towards the closed position by a biasing member, but is free to rotate about the hinge 241 to open to allow the downhole flow of fluids or downhole passage of pump-down tools such as balls, darts, plugs, or keyed plugs therethrough. A retaining mechanism (not shown) for the opening sleeve 220 may be used to retain the opening sleeve 220 in an open position after it has been shifted to an open position.

Fluids may be pumped through the stage tool assembly 100 and one-way valve in a forwards direction, and pump-down tools such as balls, darts, plugs, or keyed plugs may pass through the one-way valve in a downhole direction when the valve is in either the deactivated-open position or activated position. In order to ensure the passage of pump-down tools at low pump rates, it may be preferable to install the one-way valve in a deactivated-open position.

The tubular string mounting the stage tool assembly may comprise an open hole lower completion, with the stage tool assembly uphole of the open hole lower completion. The open hole lower completion may comprise a multi-stage open-hole hydraulic-fracturing completion. The open-hole lower completion may comprise two or more stimulation stages.

In the application of open-hole multi-stage hydraulic-fracturing a ball is typically pumped to the toe of the tubular body 10 where it lands in a ball seat 107, plugs the flow path through the tubular body 10, and allows pressure to be increased inside the tubular body 10 to set open hole packers 103*a,b,c* (tubular body 10, ball seat 107, and packers 103*a, b,c* shown in FIG. 1). The pressure inside the tubular body 10 is then increased to open the stage tool assembly 100 (which may also result in the one-way valve being shifted from the deactivated-open position to the activated position). The pressure at which the packers 103*a,b,c* are set and the pressure which the stage tool assembly 100 is opened may be higher than the pressure which will be exerted at the stage tool assembly 100 by the cementing operations. After the stage tool assembly 100 is opened (exposing the ports 203) by shifting the opening sleeve 220, the flapper valve 240 may close, thereby trapping a pressure below the flapper valve 240 which is greater than the pressure that may later be exerted above the flapper valve 240 by the cementing operations; this trapped pressure may hold the flapper valve 240 in the closed position throughout the cementing operations. A one-way valve may be geometrically configured with portions of the one-way valve that are adjacent to or above the ports in any configuration; however, the one-way valve is still defined as being below the ports if it is able to fulfil the function of trapping pressure below the one-way valve when the stage tool is in an open configuration. It is contemplated (but not shown) that the flapper valve 240 may have a slotted or ribbed geometry on the upper or lower faces (excluding the seal face which is typically flat); said geometry may provide the required strength and stiffness to the flapper valve 240 while minimizing drilling problems when drilling out the stage tool assembly 100.

Figures 4A, 4B, 4C:
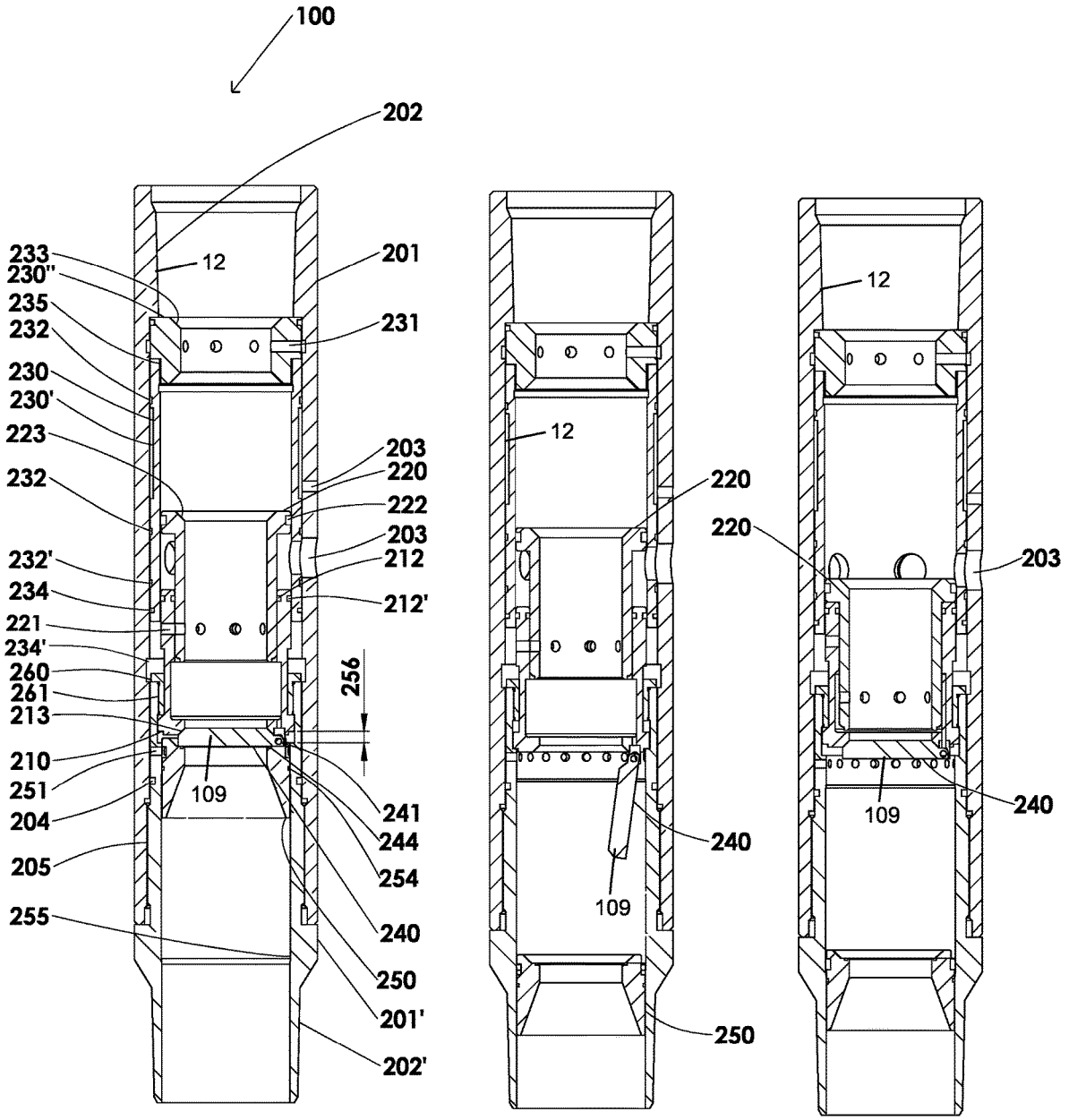
FIG. 4A is a side cross section view of an embodiment of a stage tool with an integral one-way valve, wherein the one-way valve is a flapper type in a deactivated-closed position and the opening sleeve and closing sleeve of the stage tool are in a RIH configuration.
FIG. 4B is a side cross section view of FIG. 4A with the one-way valve is in an activated position and the opening sleeve and closing sleeve of the stage tool are in a RIH configuration.
FIG. 4C is a side cross section view of FIG. 4A with the one-way valve is in an activated position, the opening sleeve in an open position, and closing sleeve in a RIH configuration.

FIGS. 4A-4C illustrate a stage tool assembly 100 with a valve lock. The assembly 100 may have a one-way valve below the ports 203 wherein the one-way valve is installed in a deactivated-closed position and may be used as a float-in sub. The valve lock may be structured to hold the valve in a closed position in the deactivated mode. In the example shown, when in the deactivated mode, the valve prevents flow through the interior bore. When in the deactivated mode, the valve may prevent tool passage in a downhole direction. FIG. 4A illustrates the cross-section view of the stage tool assembly 100 in the RIH configuration, with the one-way valve in a deactivated-closed configuration. The one-way valve may be integral with the stage tool assembly 100; the one-way valve is of a flapper valve 240 type with a hinge 241 between the flapper valve 240 and the sleeve 210; in the activated-closed position, the flapper valve 240 seals to prevent flow only in an uphole direction within the tubular body 10; the seal between the flapper valve 240 and the sleeve 210 is formed by a seat profile 213. The valve lock may comprise a retainer sleeve 250 axially movable from a first position that locks the valve in the deactivated mode to a second position that unlocks the valve into the activated mode. In the deactivated-closed position, the flapper valve 240 seals to prevent flow through the device in a downhole direction by seals 244 between the flapper valve 240 and retainer sleeve 250. This seal 244 is shown being circular with a flat face, but an alternate design which allows the largest possible diameter for pump-down tool passage therethrough, uses a curved (pringle-shaped) flapper (e.g., the flapper geometry illustrated in US20190264534A1) which has a curved upper and lower faces, which may require the mating seats on both the upper and lower faces to have matching curvature. The valve lock may comprise a shear pin. The retainer sleeve 250 is held in axial constraint relative to the lower housing 201' by means of a shearable device such as shear pins 251 and a seal is formed between the same components by a seal 244. A seal 254 seals between the retainer sleeve 250 and the lower housing 201'. A certain length of the lower housing 201' may have a larger ID section 255 to allow relatively unrestricted movement of the retainer sleeve 250 in a downwards direction after the retainer sleeve 250 is sheared in order for it to fully move out of the way of the flapper valve 240 so that after the retainer sleeve 250 has been shifted it does not impede the opening of the flapper valve 240 or the passage of pump-down tools such as balls, darts, plugs, keyed plugs, smart plugs or electronic plugs through the flapper valve 240. A retaining mechanism (not shown) for the retainer sleeve 250 may be used to retain the retainer sleeve 250 in a lower position after it has been shifted. The retainer sleeve 250 may be sheared by increasing the pressure above the flapper valve 240 to a certain amount which causes the shear pins 251 to fail, and the retainer sleeve 250 to shift downwards to a position approximately indicated in FIGS. 2B and 2C. After the retainer sleeve 250 has moved, the one-way valve is activated and the flapper valve 240 is free to pivot open, rotating about the hinge 241. The removeable sleeve 210 which the flapper valve 240 is attached to by means of the hinge 241 may be able to travel a distance which may be approximately 1.5 times the diameter of the shear pins 251 (but may range from 0.1 to 2.5 times the diameter of the shear pins 251) in order to ensure a clean and complete shearing of the shear pins 251. The movement of the removeable sleeve 210 may be constrained by shoulders, for example in this embodiment the downward limit is provided by a shoulder of the lower housing 201' and the upward limit is provided by a shoulder ring 260 which is coupled to the lower housing 201' by means of a thread 261. A retaining mechanism (not shown) for the removeable sleeve 210 may be used to retain the removeable sleeve 210 in a lower position. The shoulder of the sleeve 210 is larger than the drift diameter which may eventually be drilled out and therefore if the sleeve 210 is made from a non-dissolvable material, features as are known in the art may be used to provide problem free drilling (such as vertical slots to minimize the size of debris, and anti-rotation features which may include castellations or teeth on the lower shoulder or a tapered lower shoulder which causes the removeable sleeve 210 to jam instead of rotating when it is drilled on).

FIG. 4B illustrates a stage tool assembly 100 after the retainer sleeve 250 has been shifted and the flapper valve 240 is fully open; this represents a position of the flapper valve 240 at a time when the flow of fluids in a downhole direction or the passage of pump-down tools such as balls cause the flapper valve 240 to pivot into a fully open position against the force of a biasing device which may bias the flapper valve 240 towards a closed position. The opening sleeve 220 and closing sleeve 230 are both still in the respective original (RIH) configurations. This configuration of FIG. 4B may also be representative of a one-way valve which is RIH in the activated position at a time when the flapper valve 240 is opened by pumping through it in a downhole direction. If the one-way valve was used as a float-in sub then shortly after the instant when the retainer sleeve 250 is shifted and the flapper valve 240 opens, then the lower portion of the tubular body 10L below the one-way valve is filled with a higher density fluid through the one-way valve from the upper portion of the tubular body 10U. If the low density fluid in the lower tubular body 10L is gas (typically air) then it is rapidly compressed and some gas may swap into the upper tubular body 10U where it may be bled off at surface (during this transient event while primarily liquid is flowing in a downhole direction causing the one-way valve to open, low density fluid from the lower tubular body 10L may be able to swap in an uphole direction past the one-way valve despite the one-way valve being in the active position), and some of the gas may remain in the lower portion of the tubular body 10L. The low-density fluid is displaced into the formation, or circulated to surface. Completions fluid may be pumped in a forward direction to displace the lower portion of the tubular body 10L and the annulus between the lower completion 11 and the wellbore 1 (e.g., to recover drilling mud), and pump-down tools such as balls may be pumped through the one-way valve to land in seats such as a ball seat 107 or a seat of a debris sub 102. After a ball is landed on a ball seat 107 of the lower completion or a seat of a debris sub 102, the pressure inside the tubular body 10 may be increased to set one or more packers 103*a,b,c*, and after setting packers the pressure may be further increased inside the tubular body 10 to open the stage tool assembly 100 by shifting the opening sleeve 220 (wellbore 1, lower and upper portions of the tubular body 10L and 10U, lower completion 11, debris sub 102, ball seat 107, shown in FIG. 1).

FIG. 4C illustrates a stage tool assembly 100 after the opening sleeve 220 is shifted to expose the ports 203. When the ports 203 are suddenly exposed, the pressure inside the upper portion of the tubular body 10U above the one-way valve suddenly drops as fluid is allowed to escape into the upper portion of the wellbore 1U through ports 203. The flapper valve 240 is biased towards a closed position by the biasing device and/or the instantaneous flow in an uphole direction (in the event that the biasing device was weak or broken and the flapper valve 240 did not happen to be already positioned on or near the flapper seat profile 213 the high instantaneous flow rate in an uphole direction may be sufficient to close the flapper valve 240). The pressure which was present in the lower completion 11 prior to opening the stage tool assembly 100 is trapped by the one-way valve (lower and upper portions of the tubular body 10L and 10U shown in FIG. 1). Cementing operations commence during which the pressure above the stage tool assembly 100 is increased as cement (which typically has a higher density and viscosity than drilling mud or completions fluid) is circulated through the stage tool ports 203 and into the annulus between the upper portion of the tubular body 10U and the wellbore 1U. When in the closed position and the activated mode, the valve may be held in the closed position by a pressure differential across the valve. The flapper valve 240 may trap pressure below the flapper valve 240 which is greater than the pressure exerted above the flapper valve 240 by the cementing operations; this trapped pressure may allow the flapper valve 240 to remain in the closed position throughout the cementing operations. Even if majority of the stage tool assembly 100 is non-dissolvable and designed to be drilled-out, it may still be desirable to use a dissolvable material for the flapper valve 240 and the retainer sleeve 250 because they are relatively large and round and are unsupported at the lower end and may cause drill out problems. In general, the isolation assembly may comprise a dissolvable material, for example all or part of the isolation assembly may be dissolvable. A dissolvable part, for example a metal part, may dissolve in the presence of an electrolyte. Galvanic corrosion (also called bimetallic corrosion or contact corrosion) is an electrochemical process in which one metal corrodes preferentially to another when both metals are in electrical contact, in the presence of an electrolyte.

Alternatively, the retainer sleeve 250 may be frangible, it may break into many small pieces when it is shifted. The retainer sleeve 250 may be segmented, a segmented retainer sleeve may be held in place by the circular shape that they are assembled together in with the shearable device in the RIH configuration and separate into many small pieces when the flapper valve 240 is activated; a segmented retainer sleeve 250 may be sealed by foil on the upper and outer faces. In general, the isolation assembly or part of it may comprise frangible material.

Figure 4D:
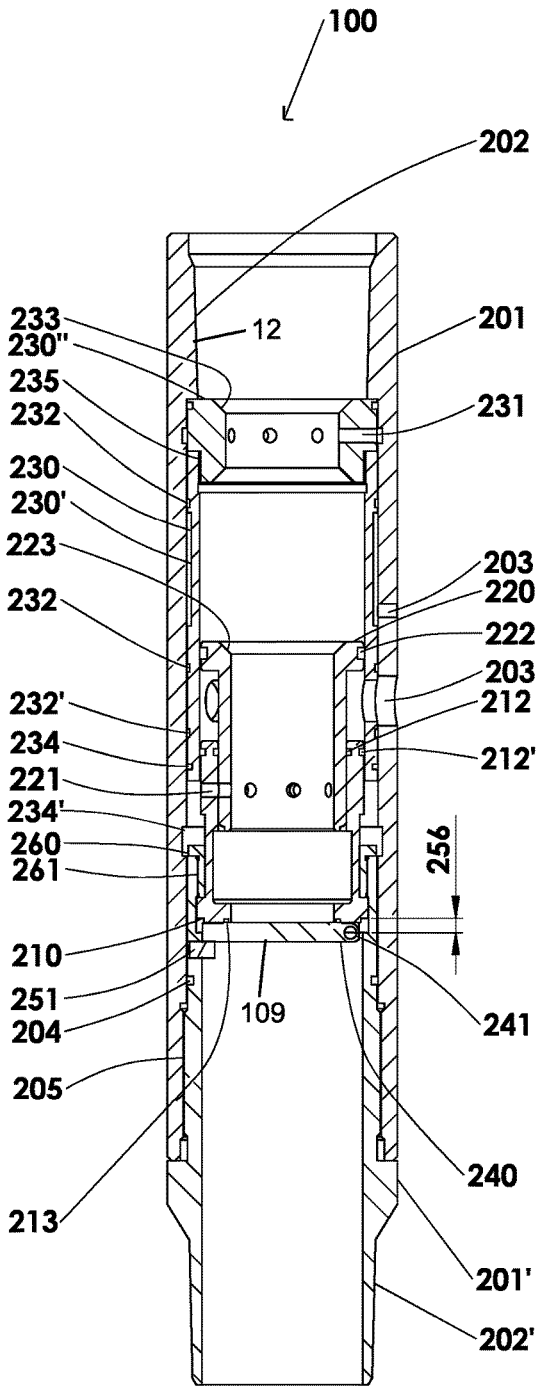
FIG. 4D is a side cross section view of an alternate embodiment of a stage tool with an integral one-way valve, wherein the one-way valve is a flapper type in a deactivated-closed position without a retainer sleeve.

FIG. 4 D illustrates a cross-section view of a stage tool assembly 100 with a one-way valve below the ports 203 wherein the one-way valve is a flapper valve 240 installed in a deactivated-closed position and may be used as a float-in sub, shown in the RIH configuration. A flapper seat profile 213 may be flat (instead of angled), and may include a groove with an elastomeric seal. A shearable device may be a single shear pin 251 may be located opposite of the flapper hinge 241. Alternatively, multiple shear pins may be disposed around the circumference, or other shearable devices may be used. A shearable device may be assisted by the flapper hinge 241 hold the flapper valve 240 in a deactivated-closed position. The removeable sleeve 210 may be a translatable sleeve. The removeable sleeve 210 which the flapper valve 240 is attached to by means of the hinge 241 may be able to travel a distance which may be approximately 1.0 times the diameter of the shear pin(s) 251 (but may range from 0.1 to 2.5 times the diameter of the shear pins 251) in order to ensure a clean and complete shearing of the shear pins 251. The movement of the removeable sleeve 210 may be constrained by shoulders, for example in this embodiment the downward limit is provided by a shoulder of the lower housing 201' and the upward limit is provided by a shoulder ring 260 which is coupled to the lower housing 201' by means of a thread 261. In this embodiment the sleeve 210 may be able to slide in a downwards direction, and has a cross section area defined by the difference in a diameter of the seal between the removeable sleeve 210 and the opening sleeve 220 and a diameter flapper seal profile 213; because of this cross-section area a differential pressure from above allows a flapper seal to be pressure-energized. This configuration without a retainer sleeve having separate seals for sealing pressure from above may be challenging to avoid damage to an elastomeric seal on the flapper seat profile 213 during the activation of the one-way valve; in order to avoid movement or damage to the seal during the flapper activation, a bonded seal may be necessary. This configuration without a retainer sleeve 250 may be challenged with undesired interference between the radially outward portion of shear pin(s) and the flapper valve 240 that may prevent the flapper from fully closing or opening when the flapper is in an activated position.

Figure 4E:
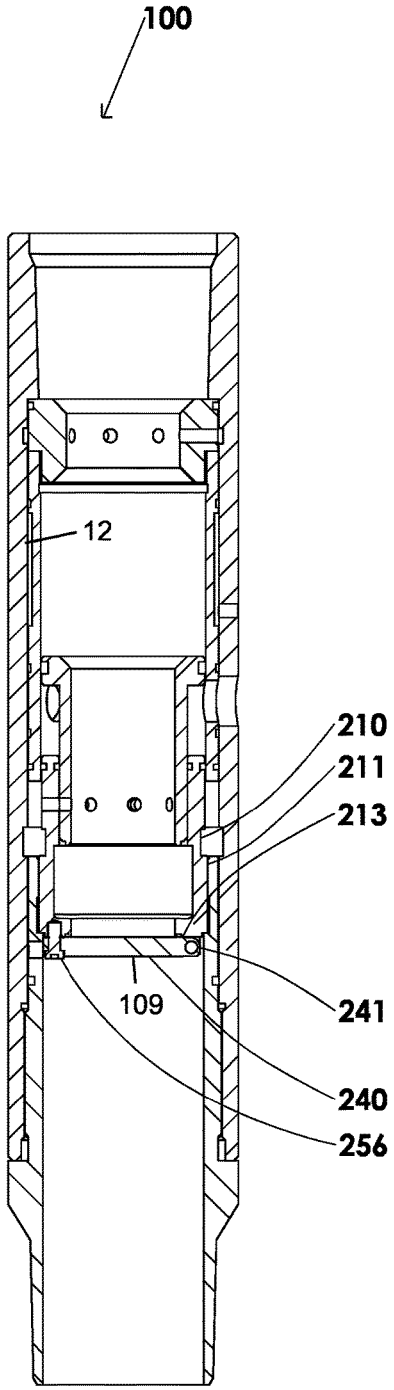
FIG. 4E is a side cross section view of an alternate embodiment of a stage tool with an integral one-way valve, wherein the one-way valve is a flapper type in a deactivated-closed position held in place with a tensile member.

FIG. 4E illustrates a cross-section view of a stage tool assembly 100 with a one-way valve below the ports 203 wherein the one-way valve is a flapper valve 240 installed in a deactivated-closed position and may be used as a float-in sub, shown in the RIH configuration. A single tensile member 256 may be located opposite of the flapper hinge 241. Alternatively, multiple tensile members may be disposed around the circumference. One or more tensile members may be assisted by the flapper hinge 241 hold the flapper in a deactivated-closed position. The removeable sleeve 210 and the housing may be coupled in a manner (such as a threads 211) that provides no axial movement, and a tensile member 256 may couple between the removeable sleeve 210 and the flapper valve 240 such that the flapper hinge 241 works with a tensile member 256 to hold the flapper in a deactivated-closed position, and a strong flapper hinge 241 may be larger and stronger compared to other embodiments. Pretension within the tensile member 256 may assist in maintaining an appropriate gap to seal between the removeable sleeve 210 and the flapper valve 240 as the differential pressure from above is increased. Additionally, a stiff flapper (which may be achieved for example, by use of a stiff material or a thick cross section in the flapper) may help maintain an effective seal. A tensile member 256 may fail in tension when a desired pressure is exerted above the flapper valve 240. A tensile member 256 may include a neck portion with a smaller cross-section area where it is designed to fail in tension at an intended force. A tensile member 256 may be a bolt, a rod, a stud, or fixed by any manner at either end. One or both ends of a tensile member 256 may be retained within the piece in which they were installed, or one or both ends of a tensile member 256 may become loose after tensile failure. If both ends of a tensile member 256 are retained, then pretension in a tensile member 256 may help avoid undesired interference between the two ends of a tensile member 256 that may prevent the flapper valve 240 from fully closing when the flapper is in an activated position. If multiple tensile members 256 are used, a challenge is to ensure complete opening, a strong and stiff flapper hinge 241 may be required. An alternative embodiment (not shown) contemplated, the flapper seat profile 213 may be inclined relative to the wellbore 1, a benefit of having the flapper seat inclined may be to provide more room for a tensile member 256.

Figure 5A:
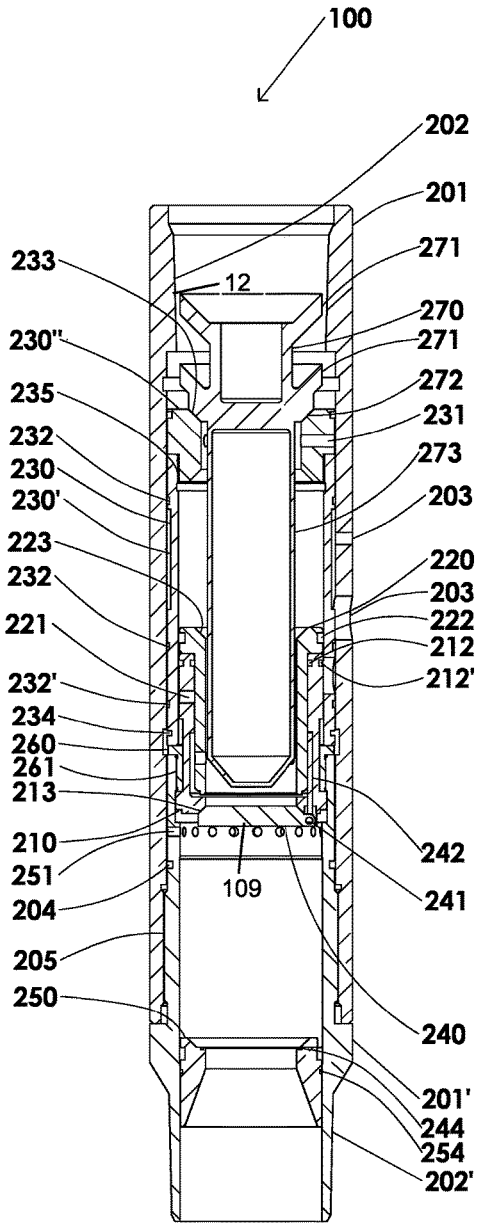
FIG. 5A is a side cross section view of an embodiment of a stage tool in a closed configuration.

FIG. 5A is representative of the stage tool assembly 100 of either FIG. 3 or FIG. 4 in the closed position after a wiper plug 270 has shifted the closing sleeve 230 fully into the closed position. The wiper plug 270 is typically pumped after the cement, and a spacer of non-cementitious fluid, inhibited fluid, or inhibited cement may be pumped ahead of the wiper plug 270. The wiper plug may have one or more fins to wipe the upper portion of the tubular body 10U (shown in FIG. 1) and maintain a clean interface between the cement ahead of the wiper plug 270 and the water or other fluid behind the wiper plug. The wiper plug 270 has a seat profile 272 which engages with the closing sleeve seat profile 233 of the closing sleeve 230 in a sealing fashion. Pressure is increased above the wiper plug 270 (the amount that the pressure is increased is called "plug bump pressure") in order to shift the closing sleeve 230 fully into a closed position by shearing shear pins 231. Seals 232 straddle the ports 203 in the housing 201. The one-way valve may be in a closed position still holding trapped pressure below the one-way valve at the time of plug bump. After the wiper plug 270 is landed and plug bump pressure is applied, the pressure above the wiper plug 270 may exceed the trapped pressure below the one-way valve causing the one-way valve to open, which may be an important function of the one-way valve because it prevents hydraulic locking of the closing-sleeve 230. When the closing sleeve 230 is shifted fully to the closed position, snap ring 234 expands radially outward into a groove 234' in the upper housing 201 and prevents the closing sleeve 230 from being unintentionally shifted out of the closed position during a drill out or other future completion or production operations on the well. The wiper plug 270 may optionally have an extended nose which displaces a portion of the cement volume from out of the stage tool assembly 100 between the closing sleeve seat profile 233 and the one-way valve 240, which may be a necessary function for a fully dissolvable stage tool assembly 100 and one-way valve assembly. For a drillable stage tool, however, it may be preferential for the wiper plug to not have an extended nose 273. FIG. 5A includes both the flapper poker 242 and the retainer sleeve 250; the reader should understand that these components may not be used together in a stage tool assembly 100, however either component or other similar components that fulfil similar functions may be present and the final closed position and function of the stage tool assembly 100 is independent of such components. In general, after cementing, stimulation operations, completion operations, or production operations may include one or more of dissolving, drilling, or destroying the isolation assembly.

Figure 5B:
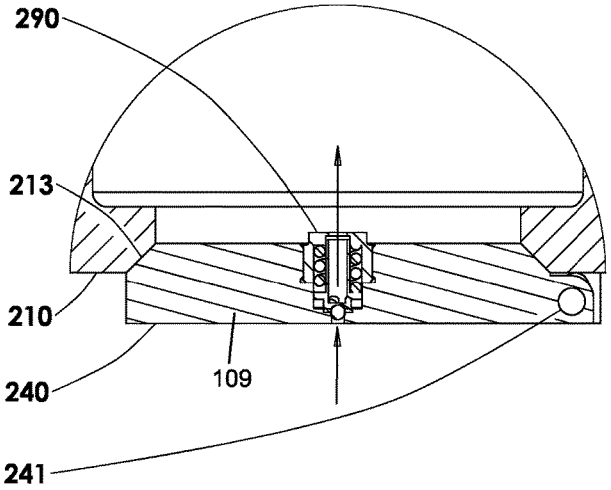
FIG. 5B is a side cross section detail view of an embodiment of a stage tool with a flapper in a closed position with a pressure relief valve (PRV).

FIG. 5B illustrates an embodiment wherein the valve comprises a pressure relief valve 290. FIG. 5B is a cross section detail of a flapper valve 240 in an activated-closed position with a pressure relief valve. The valve 290 may allow flow in an uphole direction when a pressure differential across the valve exceeds a predetermined threshold. The method may include partially releasing differential pressure across the one-way valve via the pressure relief valve. The pressure relief valve 290 is coupled to the flapper valve 240, and may alternatively be coupled instead to other locations and components in the one-way valve including a removeable sleeve 210 or a housing. The pressure relief valve 290 components may be sufficiently small and light that they do not significantly interfere with completions or production operations or need to be dissolved or create problems for a drill out operation even if a pressure relief valve is coupled to a component which is removed such as a flapper valve 240 or a removeable sleeve 210. If, as an alternative, the pressure relief valve 290 is located in a housing (not shown) then the pressure relief valve may be permanent. The pressure relief valve 290 may allow flow therethrough in the uphole direction as indicated by the arrows when a differential pressure across the pressure relief valve exceeds a predetermined threshold. A pressure relief valve 290 may be used to limit the amount of differential pressure that may be trapped in a sustained manner below a one-way valve. For example, the cracking pressure of the pressure relief valve 290 may be set at 1.0 to 1.5 times the increase in hydrostatic pressure that will be exerted at the stage tool assembly 100 by the column of cement slurry versus the column of fluid above the stage tool at the time when the stage tool was opened (further discussion on FIG. 9). The pressure relief valve 290 may have a relatively restrictive flow path to reduce the flowrate therethrough. After the stage tool assembly 100 opens, the pressure that is trapped below the stage tool may take some time to decline, depending on the differential pressure, the fluid composition, and the restriction provided through the pressure relief valve 290 (e.g., it may be expected to take between 10 seconds and 30 minutes for the differential pressure across the one-way valve to decline to approximately the closing pressure of the pressure relief valve). It may be desirable to have a low flow rate through the pressure relief valve 290 because the instantaneous pressure above the one-way valve after the stage tool opening sleeve 220 is activated may be an unpredictable short-duration transient event, and therefore it is undesirable for the pressure relief valve 290 to come to equilibrium during the transient event. The pressure relief valve 290 may require sufficiently large clearances in the flow path to avoid plugging, especially for applications with drilling mud. Cracking pressure describes a differential pressure at which a pressure relief valve 290 opens; closing pressure describes a differential pressure at which a pressure relief valve closes. A pressure relief valve 290 is illustrated with a seal that is formed by a ball and a seat, where the seat comprises of a bore in the flapper valve 240. An insert seat (not shown) may be used for more reliable sealing, and an elastomer seal (also not shown) may also be used, or the pressure relief valve 290 may be an integral component.

Figure 6:
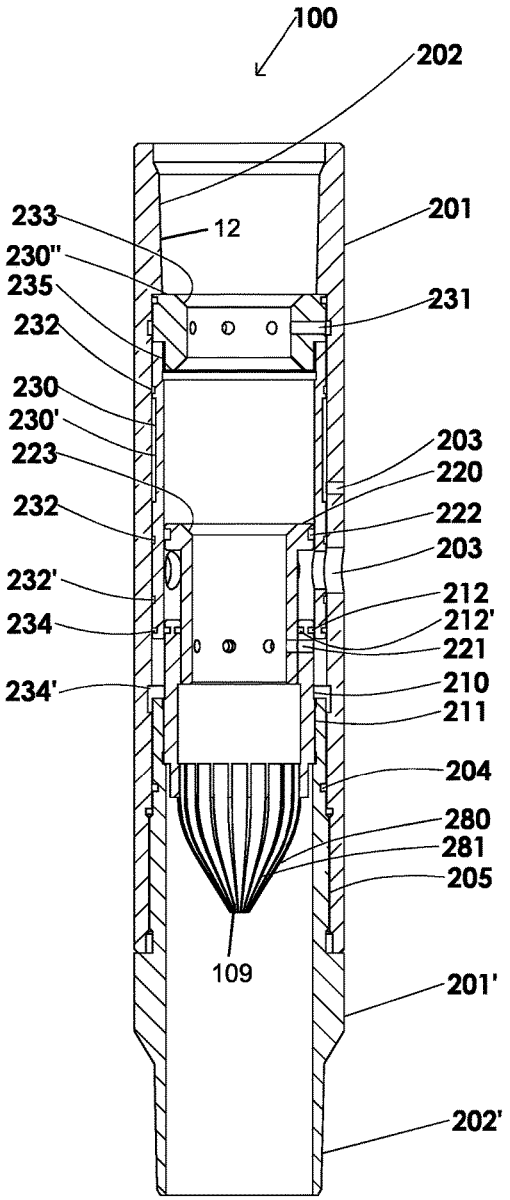
FIG. 6 is a side cross section view of an embodiment of a stage tool with a flow restrictor in a RIH configuration.

FIG. 6 illustrates a stage tool assembly 100 in which the isolation assembly comprises a flow restrictor 280. The flow restrictor may be structured to: open to permit tool passage in a downhole direction through the interior bore; and close in the absence of flow or tool passage to restrict flow within the interior bore. The assembly 100 is illustrated with a non-sealing flow restrictor 280 located below the stage tool ports 203. The flow restrictor 280 is formed of resilient structures, which allow the unrestricted flow of fluids and the passage of pump-down tools such as balls, darts, plugs, keyed plugs, smart plugs or electronic plugs in a downhole direction. The method may include passing one or more pump-down tools and fluids through the interior bore of the stage tool assembly. The flow restrictor may comprise a plurality of fingers 281. For example, in the embodiment shown, the flow restrictor 280 may comprise thin curved metal fingers 281 (the plurality of fingers may form a finger basket). The fingers 281 may be coupled to a thin ring by means of spot welding which is then coupled to the removeable sleeve 210 (the details are not shown), or the fingers 281 may be coupled directly to the removeable sleeve 210. While fluids or pump-down tools are passing the flow restrictor 280 in a downward direction the fingers 281 flex in a downhole and radial outwards direction to allow unrestricted passage. The flow restrictor 280 restricts the size of any single gap to a relatively small size (typically smaller than 1" or smaller than 0.1") in order to reduce or prevent the rate of specific gravity swapping that may occur between the cement above the flow restrictor 280, and the relative lower density fluid below the flow restrictor 280. The function of the flow restrictor 280 is similar to that of a non-sealing one-way valve which does not trap pressure below it. A flow restrictor 280 used without a one-way valve may still allow the undesired flow of cement past it in downhole direction due to the compressibility of the lower completion and fluid therein. Generally, during the cementing operation, the flow restrictor may restrict movement of cement downhole of the flow restrictor.

Figure 7A:
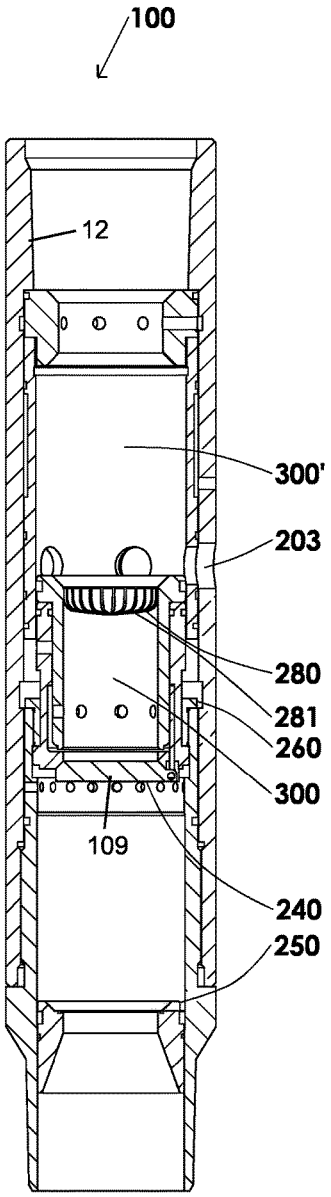
FIG. 7A is a side cross section view of an embodiment of a stage tool with a flow restrictor and a one-way valve in an open configuration.
Figure 7B:
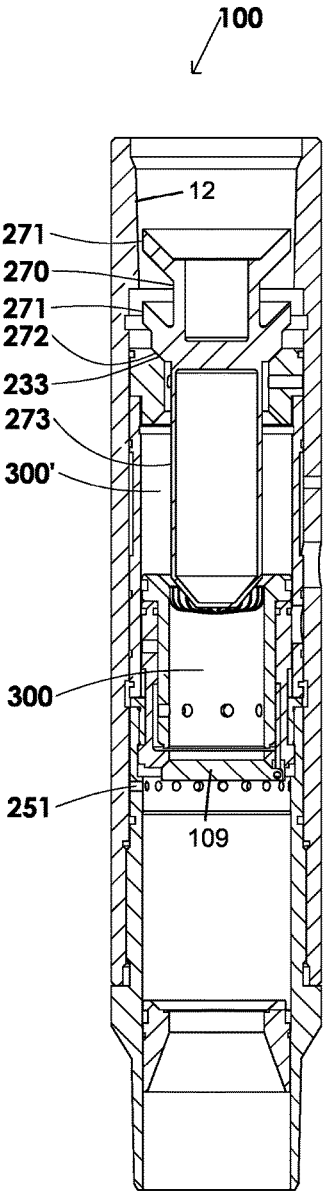
FIG. 7B is a side cross section view of an embodiment of a stage tool with a flow restrictor and a one-way valve in a closed configuration.

FIGS. 7*a* and 7*b* illustrate a stage tool assembly 100 with a one-way valve of a flapper 240 type and a non-sealing flow restrictor 280 used together wherein both provide a unique and additive function for a fully dissolvable stage tool. Referring back to the extended nose of the wiper plug 270 in FIG. 5, cement may swap into the space 300 between the ports 203 and the one-way valve 240 early in the cementing operations, and sit static in this space for the duration of the cementing operations, said duration may exceed the time for the cement to develop substantial static-gel-strength; if the cement in this space develops excessive strength it may impede the passage of the extended nose of the wiper plug into this space which may then prevent the wiper plug 270 from shifting the closing sleeve 230 into the fully closed position. A shorter extended nose 273 on the wiper plug 270 as illustrated in FIG. 7*b* does not face the same risk of cement developing strength, since the extended nose extends only into space 300' between the ports 203 and the closing sleeve seat profile 233 and cement within this space 300' may be moving regularly throughout the cementing operation. The isolation assembly may comprise a one-way valve 240 downhole of the flow restrictor. Cement may be prevented from swapping into the space 300 between the ports 203 and the one-way valve 240 by flow restrictor 280 located towards the uphole end of the opening sleeve 220. The flow restrictor 280 may comprise thin curved metal fingers 281 (typically called a finger basket). The fingers 281 may be coupled to a thin ring by means of spot welding which is then coupled to the opening sleeve 220 (the details are not shown), or the fingers 281 may be coupled directly to the opening sleeve 220. Other resilient materials may be used for the flow restrictor 280 including rubber, dissolvable, or plastic materials, and other geometries may be used such as fingers which overlap, or petals that intermesh similar to a camera lens aperture. While fluids or pump-down tools are passing the flow restrictor 280 in a downward direction the fingers 281 may flex in a downhole and radial outwards direction to allow unrestricted passage. The flow restrictor 280 restricts the size of any single gap to a relatively small size (typically smaller than 1" or smaller than 0.1"), in order to reduce the rate of or prevent specific gravity swapping that may occur between the cement above the flow restrictor 280 and the relative lower density fluid below the flow restrictor 280. The embodiment of FIGS. 7*a* and 7*b* may allow for a fully dissolvable stage tool which leaves no undissolved or cementitious components of sufficient size or volume to interfere with the subsequent completions, stimulation, or production operations of the well. The components which may be dissolvable (or the majority of the component being dissolvable) include the wiper plug 270 (including the extended nose 273), the closing seat 230", the opening sleeve 220, the removeable sleeve 210, the flow restrictor 280, the flapper valve 240, the flapper hinge 241, the flapper poker 242, the retainer sleeve 250 and shear pins 231, 221, 251. Residual components which may not dissolve such as the one-way valve biasing device or seals or non-dissolvable shearable devices may be small and soft enough that they do not interfere with subsequent completions or production operations of the well. It may be possible to achieve the objective of a stage tool assembly 100 that does not require drill out by locating a flow restrictor 280 in close proximity to the stage tool ports 203 (which mitigates the phenomenon of specific-gravity swapping), and locating one or more one-way valves within 100 m, or at any location between the stage tool assembly 100 and the lower completion 11 (the phenomenon of the lower tubular compressibility alone can be mitigated by a one-way valve which may not need to be located in very close proximity to the stage tool ports 203).

Within the spirit of the invention is contemplated other combinations and placements and configurations of one or more flow restrictors 280 and one or more one-way valves including redundant duplicates thereof, in other arrangements, or functioned by other means such as mechanical actuation of the tubular body 10, by electronic or hydraulic control, or by movement of sleeves in directions opposite to those in the disclosed embodiments. The one-way valve and flow restrictor 280 may be non-integral with the stage tool components and coupled directly below the stage tool assembly 100 or indirectly through the tubular body 10.

Figure 8:
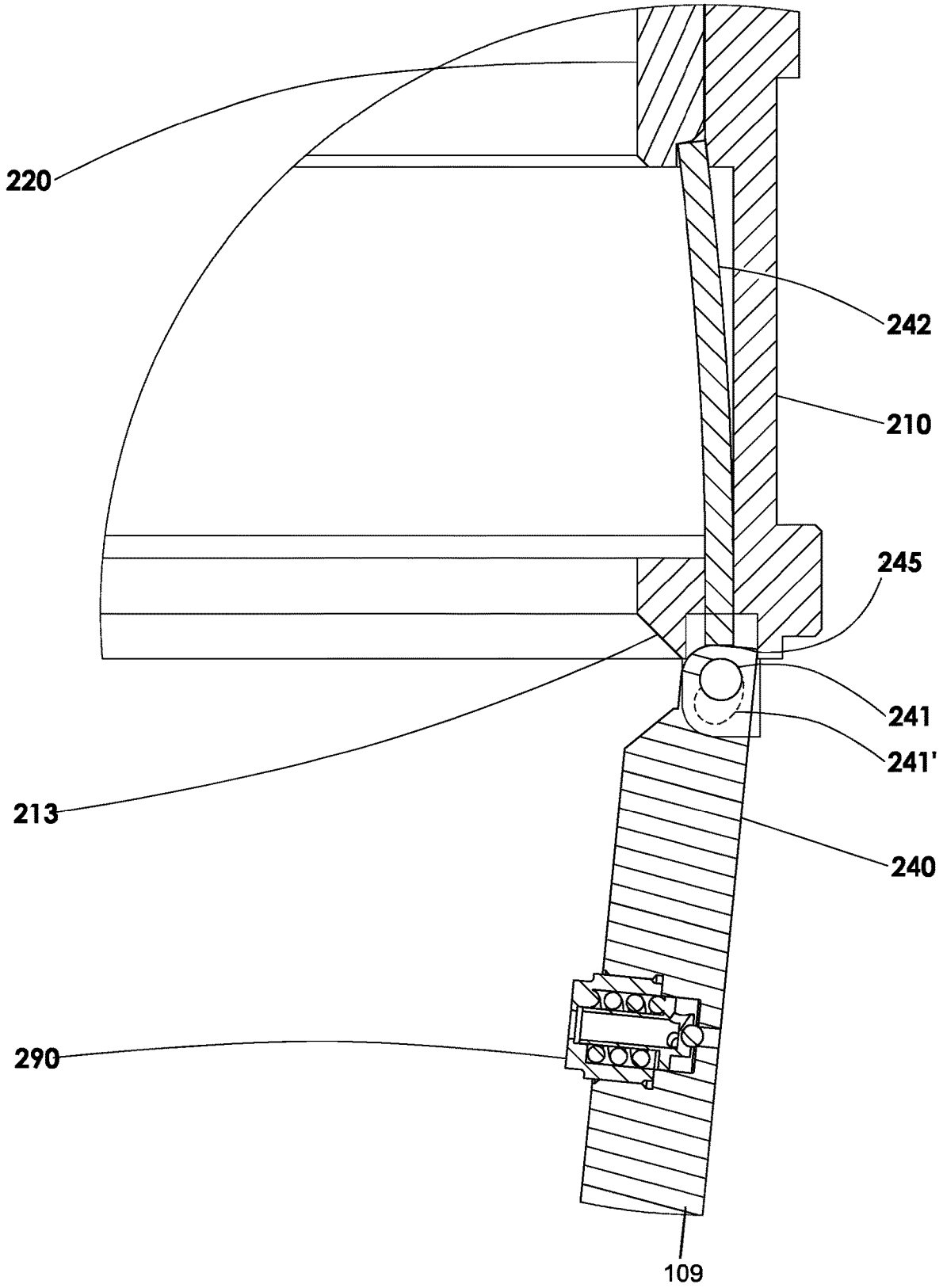
FIG. 8 is a side cross section detail view of an embodiment of a stage tool with a flapper in a deactivated-open position with a PRV.

FIG. 8 illustrates a cross section detail of a flapper valve 240 in a deactivated-open position of FIG. 3, except with a pressure relief valve 290 (refer to discussion of FIG. 5B). The flapper hinge slot 241' is shown in detail in FIG. 8 with the flapper pivot point in a RIH position, wherein it is aligned with an upper position within the flapper hinge slot 241'. The curved profile of the hinge slot may appear as a curve or J profile. The curved profile of the slot may provide more stability for the flapper when it is in the deactivated mode or the activated mode compared to a straight slot, and may help prevent unintentional shifting of the one-way valve into an activated mode or vice-versa. The hinge pin is not shown. The biasing device (typically a torsion spring) is not shown. The flapper poker 242 may be a rod positioned between the opening sleeve 220 and the flapper valve 240. The flapper valve 240 may be moved into downhole position by the motion of the opening sleeve 220 which is transmitted through a flapper poker 242; the flapper poker 242 may be elastically bent in the RIH configuration as shown in a manner such that it biases itself towards a straight alignment (refer to FIG. 3B) to remove itself from contact with the opening sleeve 220 after the flapper poker 242 has completed a downward stroke of sufficient length to move the flapper valve 240 into the activated position; the flapper poker 242 then rebounds back to a straight alignment within a space between the removeable sleeve 210 and the opening sleeve 220 which allows the opening sleeve 220 to move the remainder of the stroke length of the opening sleeve 220 without interference from the flapper poker 242 (as shown in FIG. 3). The shoulder of the opening sleeve 220 where it contacts the flapper poker 242 may be angled (bevelled) or slotted in order to maintain straight alignment of the flapper poker 242. The removeable sleeve 210 may also be longitudinally slotted (not shown) in order to maintain straight alignment of the flapper poker 242. The flapper poker 242 may alternatively be rectangular in cross section which may provide higher bending stiffness to assist maintaining straight alignment. In another alternative embodiment not shown, the hinge slot may be formed in the flapper valve 240 instead of the sleeve 210 (this configuration is not shown). When the flapper valve 240 is aligned with an upper position within the flapper hinge slot 241', the flapper valve 240 is held in the open position by contact between the flapper valve 240 and the removeable sleeve 210 which may occur at a contact location 245. Alternatively, in other contemplated configurations the flapper poker may be a ring or other geometry, or the opening sleeve itself may contact the flapper to cause it to shift into an activated position.

Figure 9:
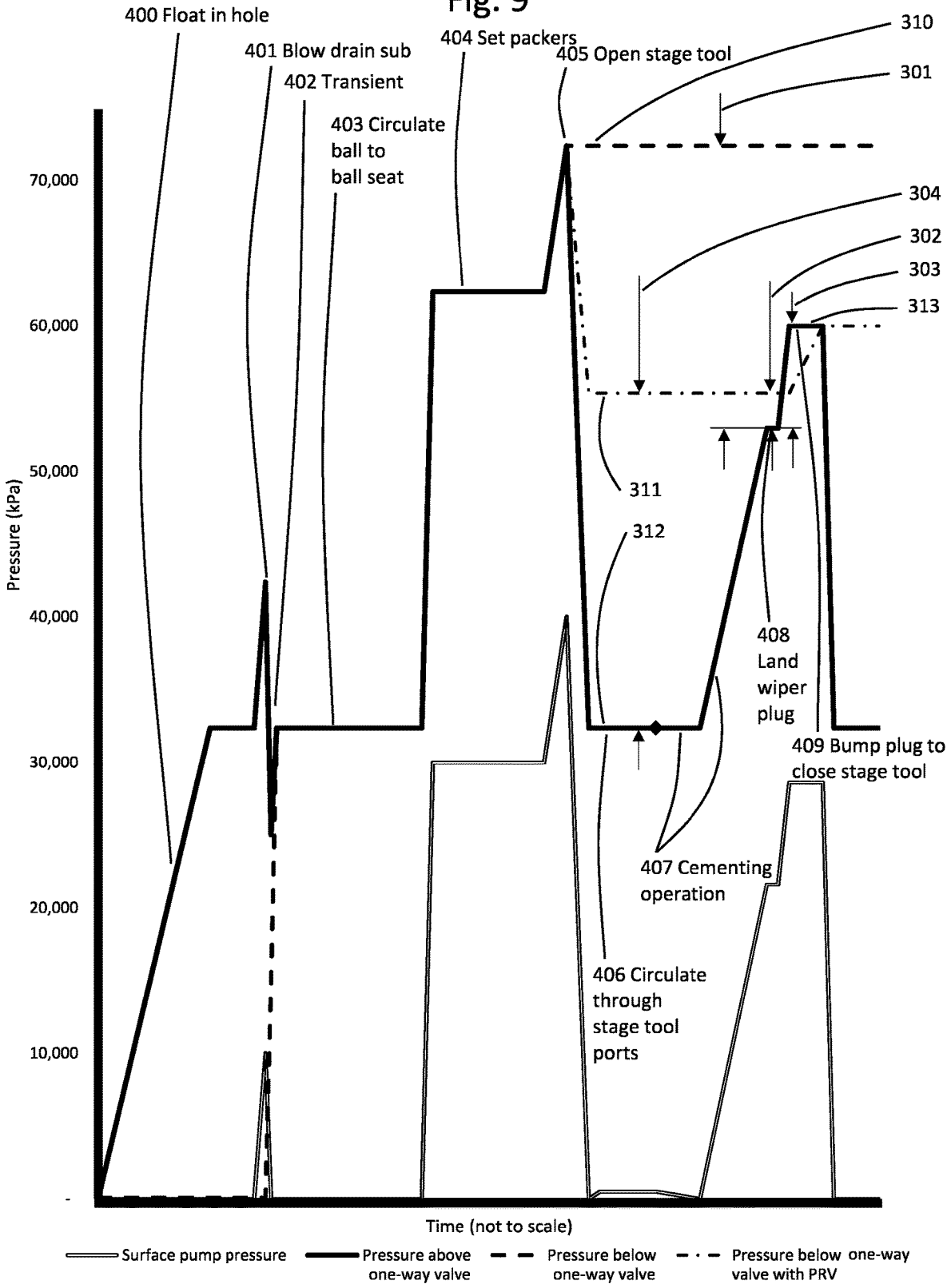
FIG. 9 is a chart of pressures during the operation of a stage tool with a one-way valve initially in a deactivated-closed position showing two scenarios—one with a PRV and another without.

FIG. 9 illustrates a pressure chart for a typical installation of a completion string with a stage tool assembly 100 and float-in sub that may be a one-way valve in a deactivated-closed position, with two scenarios—one scenario with a pressure relief valve 290 and a second scenario without a pressure relief valve 290. The X-axis represents time and is not to scale, the scale has been modified to illustrate key events rather than the duration of the events themselves. The Y-axis is pressure, note that the location of the pressure is unique for each curve. The stage tool assembly 100 is initially installed in the tubular body 10 at surface, and pressures at all locations charted are initially at atmospheric pressure (~100 kPa,a). At Phase 400 the tubular body 10 is installed; the stage tool assembly 100 is in the RIH configuration, and the one-way valve is in a closed-deactivated position; the upper portion of the tubular body 10U is filled on top of the one-way valve while being installed resulting in pressure above the one-way valve increasing as the stage tool assembly 100 is lowered in the well; the lower portion of the tubular body 10L is filled with a low density fluid (typically air and may be called "evacuated") at approximately atmospheric pressure (lower and upper portions of the tubular body 10L and 10U shown in FIG. 1). At phase 401 the tubular is installed at the target depth and surface pressure (nominally 10,000 kPa) may be applied to the upper portion of the tubular body 10U to "blow the drain sub" (or blow the float-in sub) causing the one-way valve to shift to an activated position where it allows flow therethrough in a downhole direction; this results in the pressure below the one-way valve increasing to equalize with the pressure above the one-way valve; during this time the pressure above the one-way valve may instantaneously fall below the hydrostatic gradient in the upper portion of the tubular body 10U; some gas or air from the lower portion of the tubular body 10L may swap above the one-way valve and be bled off at surface during transient phase 402. The tubular body 10 is filled and forward circulation through the toe of the tubular occurs in phase 403; pump-down tools to land in seats are pumped down from surface ("balls launched") into the tubular body 10, through the stage tool assembly 100, and through the one-way valve which may land in a ball seat 107 or a debris sub 102 or other seat in the lower completion 11. Surface pressure is applied which is transmitted through the one-way valve into the lower portion of the tubular body 10L to set open hole packers 103 in phase 404. In phase 405 the surface pressure applied is further increased which causes the stage tool assembly 100 to open. After the stage tool assembly 100 opens, the one-way valve closes and seals trapping a pressure 310 below the one-way valve, and the pressure inside the tubular declines to a pressure 312. After the stage tool assembly 100 opens, the pressure above the one-way valve equalizes with the annulus through ports 203 of the stage tool assembly 100. Circulation is established through the stage tool ports 203 during phase 406 to "condition the mud" in the upper portion of the tubular body 10U and the wellbore 1U prior to cementing operations. Cementing operations occur in phase 407 during which cement is pumped in a forwards direction; initially the downhole pressure is unchanged and surface pumping pressures decline due to the hydrostatic pressure of cement inside the tubular; after cement "turns the corner" (and starts filling the annulus between the upper portion of the tubular body 10U and the upper portion of the wellbore 1U after starting to flow through ports 203) the pumping pressure and downhole pressure above the one-way valve increase due to the hydrostatic pressure of the column of cement in the annulus. At phase 408 the pump rate is typically slowed and the wiper plug 270 lands on the closing sleeve seat profile 233 of the stage tool assembly 100. At Phase 409 the plug is "bumped" by further increasing the pump pressure to shift the closing sleeve 230 into the closed position (after holding plug bump pressure for a certain amount of time, the pressure is typically bled off which confirms the stage tool assembly 100 is closed). In order to shift the closing sleeve 230 to a fully closed position, it may be necessary to apply a higher pressure above the wiper plug 270 relative to the pressure below the one-way valve because of the fluid volume that may be trapped between the wiper plug 270 and the one-way valve after the seals 232 straddle the ports 203, but before the snap ring 234 reaches the fully closed position (as explained previously). In the scenario shown (where packers set at 30 MPa, stage tool opened at 40 MPa, 3000 m stage tool true vertical depth, 1100 kg/m3 drilling mud and completion fluid density, 1800 kg/m3 cement density, final cement top at surface in the annulus) a typical plug bump pressure of 7 MPa (7 MPa higher than the final cement pumping pressure), may not exceed the pressure 310 below the one-way valve; it may be necessary to apply a high plug bump pressure (not illustrated), that exceeds the difference shown 301 in order to shift the closing sleeve 230 to the fully closed position (this high plug bump pressure may cause the applied pressure requirement to exceed the pressure that was applied at phase 405 to open the stage tool assembly 100 which may not be practical depending on the design limits of the pressure pumping equipment or tubulars). In order to reduce the maximum plug bump pressure that that may be required to reliably shift the closing sleeve 230 to the fully closed position, a pressure relief valve 290 may allow the differential pressure across the one-way valve to be bled down (fluid flow in an uphole direction) which may be defined by a closing pressure 304 for the pressure relief valve. The closing pressure may be selected such that a relatively low plug bump pressure 303 (shown as 7 MPa for example in FIG. 9) may cause the plug bump pressure above the wiper plug 313 to exceed the pressure 311 that is trapped below the one-way valve. At the time the wiper plug is landed the pressure differential 302 across the one-way valve may be less than a typical plug bump pressure 303, said pressure differential 302 across the one-way valve at the time the wiper plug is landed being a small fraction of the original pressure differential 304 after the pressure relief valve 290 closes.

Additionally, the pressure relief valve 290 may compensate for thermal expansion—fluids which are cooler than the static bottomhole temperature may be circulated into the lower portion of the tubular body 10L during phase 403, and as the fluid expands during phases 406 and onwards when volume within the lower portion of the tubular body 10L is sealed, it may cause the pressure trapped in the lower portion of the tubular body 10L to increase above the pressure 310 shown (thermal expansion not shown). High pressures due to thermal expansion of trapped fluids may result in failure or inadvertent activation of components of the lower completion 11 or may result in the inability to shift the closing sleeve 230 to the fully closed position. Tubulars used in horizontal open-hole multi-stage hydraulic-fracturing wells and the pumping units for such stage cementing jobs typically have sufficient capacity to increase the plug bump pressure sufficiently high (not shown) such that a pressure activated ported device (for example a ported device at the toe 104*a*) is opened and allows the pressure applied above the wiper plug 270 to exceed a pressure below the one-way valve, even without a pressure relief valve. A pressure activated ported device of the lower completion 11 (such as 104*a*) may also function as a pressure relief in the event of thermal expansion over-pressure. If thermal expansion were to inadvertently open a pressure activated ported device of the lower completion 11 (such as 104*a*) before or during cementing operations and the formation exposed through the open ported device of the lower completion 11 did not have sufficient integrity, or experienced fluid loss this may result in a loss of the pressure trapped below the one-way valve which keeps the one-way valve in a closed position during the cementing operation, and thereby may result in cement being undesirably placed below the one-way valve; therefore it may be preferable to include a pressure relief valve 290 in the one-way valve to avoid this risk.

Table of Parts:

1 Wellbore
1U Upper portion of the wellbore above the stage tool ports
1L Lower portion of the wellbore below the stage tool ports
10 Tubular
10U Upper portion of the tubular above the isolation assembly
10L Lower portion of the tubular below the isolation assembly
11 lower completion - the tubular below the debris sub; inclusive of pump-down
100 stage tool
101 open hole packer
102 debris sub
103 a, b, c first, second, third open hole packers of the lower completion
104 a, b, c first, second, third ported devices of the lower completion
105 float shoe
106 float collar
107 ball seat
108 cement in the final desired placement after cementing operations
109 isolation assembly (embodiments where the isolation assembly is integral with the stage tool)
110 isolation assembly (embodiments where the isolation assembly is non-integral with the stage tool)
201 upper housing
201' top thread, typically female
202 lower housing
202' bottom thread, typically male
203 ports in the housing
204 permanent seal between the lower housing and the upper housing
205 coupler between the lower housing and the upper housing
210 removeable sleeve
211 coupler between the removeable sleeve and the housing
212 seal between the removeable sleeve and opening sleeve
212' seal between the removeable sleeve and the closing sleeve
213 flapper seat profile
220 opening sleeve
221 shear pins of the opening sleeve
222 seal between the opening sleeve and the closing sleeve
223 opening sleeve seat profile
230 closing sleeve -continued Table of Parts:

230' permanent sleeve of the closing sleeve
230" closing seat of the closing sleeve (removeable)
231 shear pins of the closing sleeve
232 permanent seals between the closing sleeve and the housing
232' seals between the closing sleeve and the housing
233 closing sleeve seat profile
234 snap ring
234' groove for retaining a snap ring of a closing sleeve in a fully closed position
240 flapper
241 flapper hinge
241' flapper hinge slot
242 flapper poker
244 seal between the flapper and the retainer sleeve
245 contact location (between flapper and the removeable sleeve with the flapper in the deactivated-open position)
250 retainer sleeve
251 shear pins of the retainer sleeve
254 seal between the retainer sleeve and the housing
255 larger ID section of the housing
256 tensile member
260 shoulder ring
261 coupler between the shoulder ring and the housing
270 wiper plug
271 wiper plug fins
272 seat profile of the wiper plug
273 extended nose of the wiper plug (optional)
280 flow restrictor
281 fingers of the flow restrictor
290 pressure relief valve
300 space between the ports and the one-way valve
300' space between the ports and the closing sleeve seat profile
301-409 pressures and phases of operations for a typical installation and use of a stage tool and one-way valve The embodiments of the invention in which an exclusive property or privilege is claimed are defined as follows:

1. A stage tool assembly comprising:

a tubular body defining an interior bore with a port, the tubular body having a top threaded casing connection and a bottom threaded casing connection;

an opening sleeve axially movable from a first position that restricts the port to a second position that exposes the port;

a closing sleeve axially movable from a first position that exposes the port to a second position that restricts the port; and an isolation assembly downhole of the port and uphole of the bottom threaded casing connection, that, at least when in an activated mode:

opens to permit flow and tool passage in a downhole direction through the interior bore; and closes to restrict flow through the interior bore.

2. The stage tool assembly of claim 1 in which the isolation assembly comprises a one-way valve.

3. The stage tool assembly of claim 2 in which the one-way valve, when in the activated mode, closes to restrict flow through the interior bore in an uphole direction.

4. The stage tool assembly of claim 2 in which the one-way valve comprises a flapper valve.

5. The stage tool assembly of claim 3 in which the one-way valve is actuatable from a deactivated mode into the activated mode.

6. The stage tool assembly of claim 5 in which, when in the deactivated mode, the one-way valve prevents both tool passage in a downhole direction and flow through the interior bore in both the downhole direction and an uphole direction.

7. The stage tool assembly of claim 5 further comprising a valve lock structured to hold the valve in a closed position in the deactivated mode.

8. The stage tool assembly of claim 7 in which the valve lock comprises one or more shear pins.

9. The stage tool assembly of claim 7 in which the valve lock comprises a retainer sleeve axially movable from a first position that locks the valve in the deactivated mode to a second position that unlocks the valve into the activated mode.

10. The stage tool assembly of claim 7 in which the one-way valve is coupled by a hinge to an axially translatable sleeve which is configured to translate in a downhole direction to move the one-way valve into the activated mode.

11. The stage tool assembly of claim 2 in which:

the one-way valve is moveable between an open position and a closed position;

when in the activated mode, the one-way valve is biased towards the closed position to restrict flow through the interior bore; and when in the closed position and the activated mode, the one-way valve is held in the closed position by a pressure differential across the one-way valve.

12. The stage tool assembly of claim 2 in which:

the isolation assembly comprises a flow restrictor;

the flow restrictor comprises a plurality of fingers forming a finger basket, which is structured to:

open to permit tool passage in a downhole direction through the interior bore; and close in the absence of flow or tool passage to restrict flow within the interior bore;

wherein the one-way valve is located downhole of the flow restrictor.

13. The stage tool assembly of claim 1 in which the isolation assembly is mounted within 100 meters downhole of the port.

14. The stage tool assembly of claim 1 in which the isolation assembly comprises a dissolvable material.

15. A method comprising installing the stage tool assembly of claim 1 uphole of an open hole lower completion within a well that penetrates an underground formation.

16. A tubular string comprising the stage tool assembly of claim 1.

17. The tubular string of claim 16 in which the stage tool assembly is located uphole of an open hole lower completion.

18. The tubular string of claim 17 in which the open-hole lower completion comprises one or more of a screen, a slotted liner, a gravel pack, a flow control device, a flow control device blocked by a dissolvable plug, a flow control valve, a sidetrack, and a barefoot hole section.

19. The tubular string of claim 17 in which:

the open-hole lower completion comprises a multi-stage open-hole hydraulic-fracturing completion with two or more stimulation stages; and each stimulation stage comprises at least one sliding sleeve that is configured to expose a port thereof when the sliding sleeve is shifted into the open position by pressure after a pump-down or tool of predetermined size or shape is landed on one or more seats of the stimulation stage.

20. The tubular string of claim 17 in which the tubular string is cemented uphole of, and uncemented downhole of, the stage tool assembly.

21. The method of claim 15 in which installing is carried out while a tubular string below the stage tool comprises a low-density fluid and a tubular string above the stage tool comprises a higher-density fluid, relative to the low-density fluid, while running the stage tool assembly in hole.

22. A method comprising pumping cement through the port of the stage tool assembly of claim 2 while the isolation assembly is in an activated mode and the one-way valve is in a closed position.

* * * * *